US008640360B2

(12) United States Patent
Stamm et al.

(10) Patent No.: US 8,640,360 B2
(45) Date of Patent: Feb. 4, 2014

(54) INTEGRATED WATER DAMAGE RESTORATION SYSTEM, SENSORS THEREFOR, AND METHOD OF USING SAME

(75) Inventors: Stephen John Stamm, Wheat Ridge, CO (US); Eric Lynn Shark, Littleton, CO (US); Nicholas Brian O'Kane, Highlands Ranch, CO (US); Ray Chapman, Boulder, CO (US); E. Scott Geschwentner, Littleton, CO (US); Sean William Flickinger, Lakewood, CO (US)

(73) Assignee: Karcher North America, Inc., Englewood, CO (US)

( * ) Notice: Subject to any disclaimer, the term of this patent is extended or adjusted under 35 U.S.C. 154(b) by 315 days.

(21) Appl. No.: 12/986,727

(22) Filed: Jan. 7, 2011

(65) Prior Publication Data

US 2011/0167670 A1 Jul. 14, 2011

Related U.S. Application Data

(60) Provisional application No. 61/293,593, filed on Jan. 8, 2010.

(51) Int. Cl.
*F26B 7/00* (2006.01)

(52) U.S. Cl.
USPC ..... 34/418; 34/491; 34/497; 340/604; 236/44 A; 236/44 C; 73/865.8; 62/92; 62/272; 702/182; 702/188; D23/383; 280/47.25

(58) Field of Classification Search
USPC ..... 34/381, 418, 491, 497; 340/604; 236/44 A, 44 C; 73/865.8; 62/92, 272; 702/182, 188; D23/383, 332; 280/47.25
See application file for complete search history.

(56) References Cited

U.S. PATENT DOCUMENTS

| | | | | |
|---|---|---|---|---|
| 2,093,725 | A | | 9/1937 | Hull |
| 2,703,199 | A | | 3/1955 | Drake |
| 2,975,609 | A | | 3/1961 | Allander et al. |
| 3,367,038 | A | * | 2/1968 | Bishop, Sr. ..... 34/485 |
| 3,653,182 | A | | 4/1972 | Welch |
| 3,725,640 | A | | 4/1973 | Kunz |
| 4,130,381 | A | | 12/1978 | Levin et al. |
| 4,176,525 | A | | 12/1979 | Tucker et al. |
| 4,424,006 | A | | 1/1984 | Armbruster |

(Continued)

FOREIGN PATENT DOCUMENTS

| | | |
|---|---|---|
| DE | 2149548 | 4/1972 |
| DE | 2413618 | 9/1975 |

(Continued)

OTHER PUBLICATIONS

"Danfoss Micro Channel Heat Exchangers: Improve the efficiency of your air conditioning system with compact heat exchangers from Danfoss," Danfoss A/S, Oct. 2008, www.danfoss.com, 4 pages.

(Continued)

*Primary Examiner* — Steve M Gravini
(74) *Attorney, Agent, or Firm* — Sheridan Ross P.C.

(57) ABSTRACT

An overall restoration system useful in removing moisture from structures is provided. The contemplated system includes a power and control device, a series of sensors, and a number of various different drying equipment, all capable of communication with a remote server. The system is highly portable, flexible and cost-efficient to manufacture and operate.

25 Claims, 35 Drawing Sheets

(56) References Cited

U.S. PATENT DOCUMENTS

| | | | | |
|---|---|---|---|---|
| 4,428,205 | A | 1/1984 | Doderer | |
| 4,466,780 | A | 8/1984 | Naurath | |
| 4,483,664 | A | 11/1984 | Armbruster | |
| 4,607,498 | A | 8/1986 | Dinh | |
| 4,786,295 | A | 11/1988 | Newman et al. | |
| 5,031,411 | A | 7/1991 | Gehring et al. | |
| 5,053,065 | A | 10/1991 | Garay et al. | |
| 5,117,651 | A | 6/1992 | Suh | |
| 5,139,546 | A | 8/1992 | Novobilski | |
| 5,174,048 | A | 12/1992 | Shero | |
| 5,265,895 | A | 11/1993 | Barrett | |
| 5,403,152 | A | 4/1995 | Trautloff et al. | |
| 5,443,624 | A | 8/1995 | Claesson | |
| 5,634,353 | A | 6/1997 | Hallin et al. | |
| 5,669,221 | A | 9/1997 | LeBleu et al. | |
| 5,794,453 | A | 8/1998 | Barnwell | |
| 5,839,155 | A | 11/1998 | Berglund et al. | |
| 5,901,565 | A | 5/1999 | Morton, Jr. | |
| 5,953,926 | A | 9/1999 | Dressler et al. | |
| D422,351 | S | 4/2000 | Griffin | |
| 6,202,322 | B1 | 3/2001 | Turner, IV | |
| 6,217,440 | B1 | 4/2001 | Wessel et al. | |
| 6,370,902 | B1 | 4/2002 | De' Longhi | |
| 6,428,610 | B1 | 8/2002 | Tsai et al. | |
| 6,428,616 | B1 | 8/2002 | Neely, Jr. | |
| 6,498,876 | B1 | 12/2002 | Liu et al. | |
| 6,523,194 | B2 | 2/2003 | Smith | |
| 6,615,508 | B1 | 9/2003 | Valle | |
| D480,467 | S | 10/2003 | White | |
| 6,655,926 | B2 | 12/2003 | Wang et al. | |
| 6,739,070 | B1 | 5/2004 | Jacobs et al. | |
| 6,796,896 | B2 | 9/2004 | Laiti | |
| 6,895,774 | B1 | 5/2005 | Ares et al. | |
| 6,899,516 | B2 | 5/2005 | Wang | |
| 6,927,686 | B2 | 8/2005 | Nieters et al. | |
| 6,976,911 | B2 | 12/2005 | Lanham et al. | |
| D517,677 | S | 3/2006 | Bartholmey | |
| 7,007,403 | B1 | 3/2006 | Studebaker | |
| 7,173,538 | B2 | 2/2007 | Pedraza et al. | |
| 7,194,870 | B1 | 3/2007 | O'Brien et al. | |
| 7,201,563 | B2 | 4/2007 | Studebaker | |
| 7,238,006 | B2 | 7/2007 | Studebaker | |
| 7,243,050 | B2 | 7/2007 | Armstrong | |
| 7,246,503 | B1 | 7/2007 | O'Brien et al. | |
| 7,281,389 | B1 | 10/2007 | O'Brien et al. | |
| 7,331,759 | B1 | 2/2008 | Tejeda | |
| 7,403,126 | B2 | 7/2008 | Pedraza et al. | |
| 7,540,166 | B2 | 6/2009 | O'Brien et al. | |
| D596,283 | S | 7/2009 | Martinez et al. | |
| 7,699,580 | B2 | 4/2010 | Lasko et al. | |
| D619,698 | S | 7/2010 | Emenheiser et al. | |
| 7,779,643 | B2 | 8/2010 | Simons | |
| 7,785,064 | B2 | 8/2010 | Bartholmey et al. | |
| 8,006,407 | B2 * | 8/2011 | Anderson | 34/381 |
| 8,161,761 | B2 | 4/2012 | Shao | |
| 2005/0202776 | A1 | 9/2005 | Avedon | |
| 2008/0066474 | A1 * | 3/2008 | Porter et al. | 62/127 |
| 2008/0072611 | A1 * | 3/2008 | Ahmed et al. | 62/175 |
| 2008/0083230 | A1 | 4/2008 | Giallombardo | |
| 2008/0173035 | A1 | 7/2008 | Thayer et al. | |
| 2009/0151190 | A1 * | 6/2009 | Anderson | 34/427 |
| 2009/0158614 | A1 * | 6/2009 | Singh et al. | 34/474 |
| 2009/0183477 | A1 | 7/2009 | Workman | |
| 2010/0011612 | A1 * | 1/2010 | Jayne et al. | 34/417 |
| 2010/0024244 | A1 * | 2/2010 | Potter | 34/474 |
| 2010/0125367 | A1 | 5/2010 | Burton | |
| 2010/0326103 | A1 | 12/2010 | Stamm et al. | |
| 2012/0227280 | A1 * | 9/2012 | Hopkin et al. | 34/492 |

FOREIGN PATENT DOCUMENTS

| | | |
|---|---|---|
| DE | 8707953 | 7/1988 |
| DE | 19731369 | 7/1998 |
| EP | 0231789 | 8/1987 |
| JP | 55107852 | 8/1980 |
| JP | 61093332 | 5/1986 |
| JP | 08-145414 | 6/1996 |
| JP | 09-089297 | 4/1997 |
| JP | 10-238810 | 9/1998 |
| JP | 2001-065917 | 3/2001 |
| JP | 2001-182965 | 7/2001 |
| JP | 2002-188827 | 7/2002 |
| JP | 2002-267204 | 9/2002 |
| WO | WO 2007/008948 | 1/2007 |

OTHER PUBLICATIONS

James, William L., "Electric Moisture Meters for Wood," U.S. Department of Agriculture, General Technical Report FPL-GTR-6, 1988, 19 pages.

"The Network is No Longer Your Worry: Synapse Product Line," SYNAPSE Wireless, Inc., copyright 2008, 4 pages.

U.S. Appl. No. 13/919,108, filed Jun. 17, 2013, Bearup et al.

Official Action for U.S. Appl. No. 13/919,108 mailed Sep. 20, 2013, 21 pages.

* cited by examiner

FIG.18
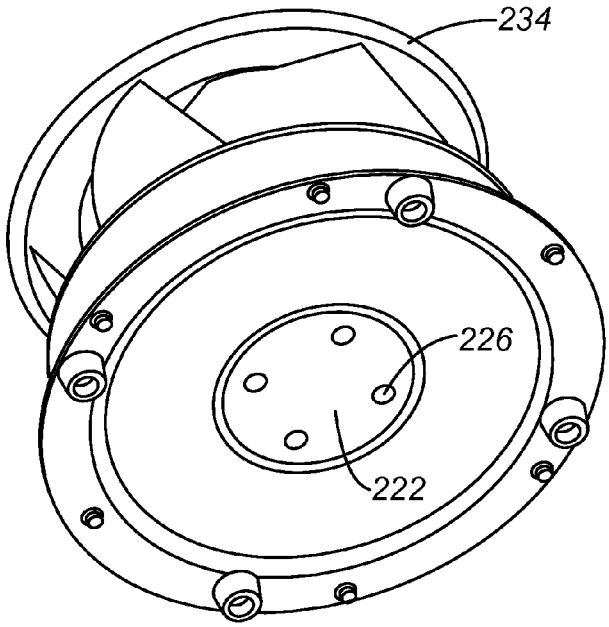
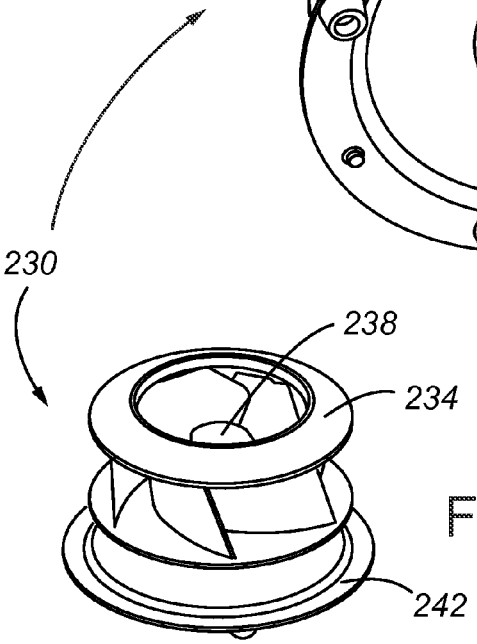
FIG.19
FIG.20
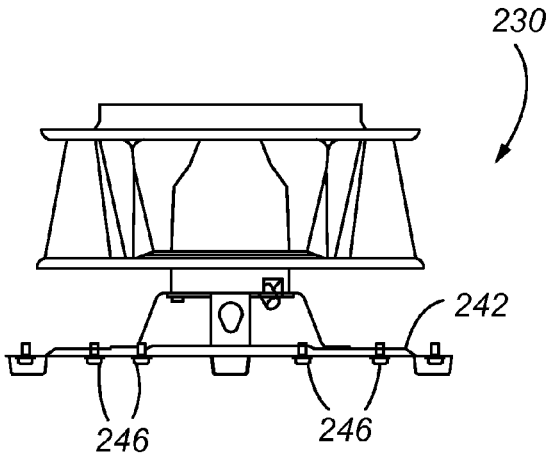

INTEGRATED WATER DAMAGE RESTORATION SYSTEM, SENSORS THEREFOR, AND METHOD OF USING SAME

This application claims the benefit of U.S. Provisional Patent Application Ser. No. 61/293,593, filed Jan. 8, 2010, the entire disclosure of which is incorporated by reference herein. This application is also related to U.S. patent application Ser. No. 12/821,958, filed Jun. 23, 2010, entitled "Dehumidifier for Use in Water Damage Restoration", the entire disclosure of which is incorporated by reference herein.

FIELD OF THE INVENTION

Embodiments of the present invention generally relate to the use, including integrated use, of various devices in a system that effectively and efficiently removes moisture and prevents the development of mold from growing in water damaged buildings, structures, etc.

BACKGROUND OF THE INVENTION

Systems and devices are commonly used to dry walls, floors, ceilings and other parts of the inside of a building that have been exposed to unusually high amounts of moisture. Moisture may enter one or more rooms of the building through any of several ways. For instance, fire sprinklers may be activated or firefighters may douse the building with water to control fires within the building. The building may also be affected by a natural disaster, such as a flood. In addition, pipes may burst or leak or fluid drainage systems may backup, thereby exposing the building to water and moisture.

Conventional water remediation systems employ a variety of equipment to dry water-damaged building interiors such as air movers, i.e., electric fans, that are used to move moist air away from areas being dried. Filters are also often used to filter airborne contaminants, such as mold spores, from the drying air. If required, one or more dehumidifiers may also be used to extract moisture from air located within the building. In some situations, heaters may also be used to increase the ambient temperature of the drying air and/or the area being dried, which increases evaporation and decreases drying time. In other situations, chemicals may be initially, intermittently, and/or continually dispersed into the drying air stream, the building, or both to inhibit the development of mold and other naturally-occurring biological contaminants. The type of equipment, equipment settings, equipment run times, etc., are usually determined and adjusted based upon the level of damage and the encountered remediation environment.

Many remediation projects are performed by professional contractors who specialize in water damage restoration and who monitor and keep records of the conditions in remediated areas to track drying progress, drying schedules, etc. Typically, relative humidity, absolute humidity, air temperature, and moisture content are monitored, as these are critical factors in determining the progress of any water remediation effort. Most commonly, contractors measure the critical factors using electronic sensors that output selected parameters. As one of skill in the art will appreciate, entering a structure to obtain sensor readings is costly and time consuming. In addition, the contractor must often manually record and document collected data.

There are several patents that have addressed some basic water remediation issues. For example, U.S. Pat. No. 7,243,050 to Armstrong and U.S. Pat. No. 7,173,538 to Pedrazza et al., which are incorporated herein in their entirety, disclose monitoring devices that receive data from sensors that may transmit collected data to a remote server through a communications network. The monitoring device is also capable of receiving data from the remote server. Thus, the monitoring device can use information either from the sensors, from the server, or a combination of both, to control drying equipment and/or monitor drying procedures. The monitoring devices are also disclosed as including USB ports through which stored information can be retrieved or external data can be uploaded.

Armstrong and Pedrazza also disclose that a single sensor may be used in some remediation circumstances, but that a plurality of sensors strategically placed within a structure being remediated is typical. The sensors may include peripheral sensors connected to the monitoring device and sensors integrated into the monitoring device. The peripheral sensors are disclosed as being positionable inside or outside the building being remediated. The references identify suitable sensors as including penetrating moisture sensors, non-penetrating moisture sensors (including scanning moisture sensors), temperature sensors (thermometers), atmospheric pressure sensors (barometers), electric current sensors, voltage sensors, power sensors, humidity sensors (hygrometers), mold detectors, air particle detectors, and air flow sensors. The number and type of sensors installed at the water-damaged building depends upon particular remediation system implementation, the size of the building, the number and size of rooms within the building, the estimated volume of moisture that must be removed, and other factors recognized by those skilled in the art.

The references also disclose that peripheral sensors may communicate with a monitoring device in any conventional manner, including through wires, radio frequency (RF) equipment and protocols, and/or through virtually any analog or digital wireless communication network and protocol. Further, the collected data can be transmitted to the remote server by an auxiliary device in any known fashion, including through a modem and telephone link, through cell phone communication technologies, through an RF link, and/or through virtually any analog/digital wireless communication system and protocol. The data sent to the remote server could be compiled, analyzed, and used to generate reports.

Pedrazza and Armstrong, however, fail to recognize the need for maintaining functionality while providing a constant, flexible, and safe power to drying equipment, which are located in a variety of remediation sites and that require a variety of available power configurations. Specifically, there is a need to provide a monitoring and control device that can accept various types of electrical power available at a restoration site and that can effectively and efficiently convert and/or split that power so that it can be used by required drying equipment. By combining the intelligent functionality of a monitoring device with necessary power provision componentry into a single device, a rugged and versatile overall power and control system is provided that can be utilized at virtually any job site.

It will also be understood by those of skill in the art that a remediation job may employ various drying protocols implemented by different types of drying equipment that are operating simultaneously. Though currently unavailable commercially, it would be advantageous to have a single monitoring device that is capable of accepting and transmitting data to drying equipment and/or sensors that have been designated for use in one of several discrete drying areas located within a single remediation site. For instance, it would be desirable to provide a monitoring device that is able to monitor and control drying equipment and/or sensors under varied protocols, communication channels or frequencies. In this way, a single monitoring device can maximize its flexibility and thus effectiveness in a given remediation setting.

It would also be advantageous to have a monitoring device that is capable of controlling operational parameters of drying equipment. Such parameters could include the speed of a fan, the frequency and intensity of dehumidification preformed by a dehumidifier, the amount of chemical(s) injected into an air flow, and/or area being remediated based upon varying site parameters, etc. The prior art does not disclose any device capable of such intelligent operation.

Further, neither Pedrazza nor Armstrong discloses a penetrating moisture sensor for use in efficiently remediating a variety of wood structures and that has a geometry that allows for effective installation. Also, neither discloses a sensor that can operate under a variety of conditions and still accurately estimate the moisture content of a room being remediated. Further, neither Pedrazza nor Armstrong discloses or teaches an overall remediation process that is enhanced by using technologically advanced dehumidifiers, air movers, air filters, quick connection ducting systems, etc. There is a definite need to address all of these issues in the field.

It should be noted that terms such as "structure", "room" and "building" are used broadly in this disclosure and are not limited to arbitrary distinctions. For example, an entire basement or any portion thereof might be regarded as a room, and the entire enclosed area of a large warehouse might similarly be regarded as a room, if conditions warrant and depending on the layout of the building. Similarly, a crawl space, storage area or other enclosed area inside a building that needs to be remediated might be regarded as a room, building, or structure as those phrases are used in this application.

As used herein, the word "fan" or "air mover" can include any powered device used primarily for blowing or otherwise moving air, including devices that might also be called blowers, compressors, etc. "Air filter" can include any powered or unpowered device including one or more media designed to remove particular matter from an air flow.

The term "dehumidifier" includes any type of device that draws, blows, or otherwise moves moisture-laden air through a condensing unit. Typically, the air passes across exposed tubes carrying cold refrigerant and moisture condenses on the cold surfaces of the tubes and any additional fins, baffles, etc. The condensation drips down a vertical surface until it reaches a low point, then it falls into a collection basin. In commercial units the basin usually is pumped out through a hose into a drain or tank under the control of a sensor that operates a pump when the basin becomes full.

Chemical dispersion systems cover any form of system that is designed to distribute chemicals into a closed area, such as a structure or a stream of air. Air heating systems include any device that is designed to heat air and may include propane forced air heaters and electrical heaters.

Devices, systems and methods are disclosed herein that address the long-felt but unresolved needs identified above. Specifically, a number of inventions are disclosed that are designed to operate either separately or together and that will facilitate efficient remediation of water damaged structures. The overall system is comprised of a power and control device, system sensors, air movers, air filters, dehumidifiers, heaters, chemical injectors, and other required devices. Inventive aspects of each of these devices and how they may be operated together to produce a robust method of remediation is discussed below.

SUMMARY OF THE INVENTION

Power and Control Device

It is one aspect of the present invention to provide a power and control device suitable for use in an area that has been exposed to a great amount of moisture. For example, one embodiment of the present invention is a self-contained power and control device for operating electronic components that resists corrosion and moisture penetration. Further, it is contemplated that the power and control device resists corrosion and other degradation so as to not leach material into or otherwise contaminate surrounding areas that may be damp or wet.

It is yet another aspect of the present invention to provide a power and control device with multi-functional capabilities. More specifically, in order to handle a variety of different tasks in a variety of different environments, embodiments of the present invention may include any number of devices, including, but not limited to, power collection and redistribution capabilities, the ability to collect data from sensors and to transmit data to drying equipment, componentry capable of transmitting and receiving various data signals from a remote server or location, componentry capable of aiding in the proper installation and set up, monitoring and control of drying equipment to be placed in a building, etc.

Those of skill will recognize that various devices of and related to the present invention are often operated in situations and environments with inadequate or unpredictable power sources. Accordingly, embodiments of the present invention can accommodate various power and current sources. For example, the power and control device may possess the ability to select between various different current types, which is advantageous, when 240 volt, 30 amp electrical current is not available, for example. Furthermore, embodiments of the present invention include insulated neutral wires that minimize the risk of shock, damage, fire, etc.

It is yet another aspect of embodiments of the present invention to provide circuitry for set-up, monitoring, and control of drying equipment. The circuitry may include volatile memory, non-volatile memory upon which firmware may be stored, a main processor and controller, and a RF engine. The circuitry may be housed on a single printed circuit board ("PCB"). More specifically, the RF engine may be comprised of a SNAPSE all-in-one module, Model Number RF2PC6 that operates on a frequency of 2.4 GHz. The device also may utilize SNAP mesh network technology to provide self-forming and healing node integration. Further, the RF engine may interact directly with controllers. The PCB also may house, among other componentry, memory devices, a debugging USB port, RF engine interface circuitry, voltage regulation and processor configuration power on reset circuitry, battery backup circuitry, interface-to-power control board circuitry, Ethernet interface circuitry, and external S-RAM and operational panel interface circuitry.

It is yet another aspect of embodiments of the present invention to provide user interaction with a main controller. For example, information relevant to a remediation project may be displayed on a display device, which may include an LCD screen. During operation of the system, data concerning environmental conditions may, but need not, periodically be processed by the main processor and displayed on the display device. Further, the user may have the ability to upload site-specific drying parameters and/or information into the power and control device that can then be used to control, configure, etc. sensors and/or drying equipment.

It is another aspect of embodiments of the present invention that are designed to accommodate receipt and/or the sending of information from multiple sensors. Further, it is contemplated that each sensor may be configured to accommodate different conditions. Accordingly, different areas having different remediation needs may be accommodated by the system. In this manner, the control device may optimize the drying procedures in a given area with exacting precision. Additionally, embodiments of the present invention contemplate the use of color-coded outlets, sensors, and other related components in order to facilitate on site set-up and operation and provide for quick determination of related or linked components, etc.

It is yet another aspect of embodiments of this aspect of the present invention to provide a power and control device that possesses wireless functionality. For example, a portable router may be integrated or included with the power and control device. The router may be battery powered or powered through a cord, which may be plugged into any of the powered GFCI outlets of the power and control device. Using a suitable patch cable, data may also be transmitted from the main processor through an Ethernet port to the router. Data may then be transmitted over the air to a remote server or other appropriate device.

System Sensors

It is yet another aspect of embodiments of the present invention to provide portable or penetrating sensors capable of interacting with a remediation system. Battery-powered sensors may be provided that monitor, for example, relative ambient humidity and ambient temperature. Data recorded by the contemplated sensors may be transmitted, for example, by a transponder (e.g. RF transponder) aided by a battery or other power source, to the power and control device in either analog or digital format. So that multiple sensors may be utilized in a single location, sensors may be capable of broadcasting data at various frequencies or channels or in other ways which prevent or minimize interference. Alternatively, sensors may be configured to send a unique identification number as part of its transmission that is used by the power and control device to recognize the particular sensor. Sensors may further include the ability to be toggled on or off manually, via wireless communication, etc.

It is yet another aspect of embodiments of the present invention to provide sensors capable of interacting and determining moisture and humidity characteristics without suffering adverse impacts from the same. Sensors and electrical componentry may be enclosed within a case wherein ambient air is allowed to enter through at least one and preferably multiple apertures in the case. In operation, air enters the apertures and comes in contact with the temperature and humidity sensors housed within the case. The primary sensor system may be placed within a structure being remediated using an integral hook or other suitable device.

It is yet another aspect of embodiments of the present invention to provide sensors capable of sensing and remediating wood structures. More specifically, a penetrating moisture sensor is contemplated that penetrates various layers of material, which may comprise a wood structure, and provides accurate and useful drying information to the user. The penetrating sensor of embodiments of the present invention may comprise various features of the sensors described above in addition to a penetrating member, such as tangs, nails, rods, screws, and similar devices. Penetrating sensors may be shaped so that penetrating members and the associated sensor engages firmly to corners or intersections of walls and floors.

It is yet another aspect of embodiments of the present invention to provide a sensor with a timer that acts in conjunction with other componentry to measure moisture content of wood included within a structure to be dried, such as a sill plate. The timer may be set up as a monostable (one-shot) circuit such that when the timer is triggered, the output of the timer is set to a high state while a capacitor charges through the wood. When the capacitor is charged, the output is set to a low state. The "on time" value equals the time the output of the capacitor remains at the high state and is associated with the time constant of the capacitor, which is the time it takes for the capacitor to reach about 63% of full charge and is represented by the formula TC=16.67 RC. As the time constant is known and the capacitance value (C) of the capacitor is known, the resistance (R) of the wood, which is proportional to the moisture content of the wood, can be calculated. The triggering and TC values may be measured using the RF engine present in the primary sensor. The TC value may then be sent back to the control device to calculate the resistance value, which is used by a main processor of the control device to estimate the total moisture content of, for example, the sill plate. Presets data may be further included in the sensor to determine the level of humidity that relates to an acceptable or desired condition.

Fan and Heater

It is another aspect of the present invention to provide an air mover suitable for use in floor and surface drying operations. The air mover may include at least one primary inlet, suited for drawing or in taking air from a region generally perpendicular to a surface to be dried and/or for connection to a duct through which air may be drawn. The air mover may further include at least one primary exhaust suitable for venting air toward or along a surface to be dried and/or for connection to an air duct.

It is yet another aspect of the present invention to provide an air mover that provides for the ability to be oriented in various different positions, as well as be stacked or aligned with one or more additional air movers. For example, an air mover of the present invention may comprise various feet or extensions that allow stable placement in a variety of positions. In addition to being positioned in what may be considered a traditional position where the air dryer is capable of directing air across a floor, the present invention may be positioned on one end such that air may be directed across a surface angled relative to a floor, such as a wall. The feet and/or extensions of embodiments of the present invention allow for the combination of multiple units to provide a greater flow rate of air across an area.

The contemplated air mover has multiple exhaust or intake portions. Louvers or apertures may be provided in one portion of the air mover, such as the bottom, such that air that is drawn in through a primary intake and exhausted through both a primary outlet as well as through auxiliary louvers or apertures. For example, louvers located on a bottom portion of the air mover facilitate drying of a surface directly below the air mover in addition to surfaces and areas located at a distance away from the air mover. Furthermore, auxiliary air inlets may be provided in addition to the primary inlet. The auxiliary inlets may rely directly on an impeller to induce air intake or may rely on air velocity within the air mover to draw in air.

It is yet another aspect of the present invention to provide an air mover that further provides the ability to heat air. As it is known that fluid solubility increases with temperature, it is often desirable to increase the temperature of air before intake to an air mover, within the air mover and/or upon exhaust from the air mover. For example, electric heating coils or wires may be provided within at least a portion of the primary exhaust. Heating coils or other heating mechanisms may draw energy from various power sources, including the air mover itself, and convert electrical energy to heat energy that heats air as it is expelled from the air mover. Alternatively, heating coils and various other heating mechanisms may be disposed within a main portion of the air mover or at the inlet of the air mover. Heating devices and means may also be incorporated at a variety of distances away from the air mover. For example, heating mechanisms may simply warm ambient air surrounding an air mover or may heat a specific volume of air associated with the air mover (e.g. air within ducting connected to an air mover at a distance from an inlet and/or exhaust).

Quick Connect Systems

It is another aspect of embodiment of the present invention to provide for devices and systems that allow for channeling or prescribed transfer to the air mover. Air movers as described herein may comprise features, such as lips and/or flanges that allow for ducting to be attached that allow for the transfer of air to and from regions that are not necessarily located proximal to an air mover. For example, where an area requiring remediation is an enclosed space and air immediately surrounding an air mover may be undesirable to use for drying purposes, air may be channeled to the enclosed space from an alternate location via ducting. Similarly, when it is undesirable to vent air directly from a primary exhaust of an air mover, ducting may be connected to the air mover to serve as a conduit for transporting exhausted air to another location.

It is another aspect of embodiments of the present invention that allows for the attachment of various ducting materials to the air mover. More specifically, one embodiment of the present invention contemplates the use of various elastic members, which may further include various fasteners and devices that facilitate attachment and removal. Devices may include elastic cords that include gripping mechanisms that facilitate interconnection to a lip or flange of the air mover. The gripping devices of embodiments of the present invention may further include the ability to slide around a circumference or boundary of an elastic member. In this manner, gripping devices may provide the ability to gradually remove an elastic member in addition to more convention "grip and pull" methods. Elastic members or similar devices may further provide the ability to be non-destructively severed in order to assist in removal and application. It is a related aspect of one embodiment of the disclosed system to provide a quick connect system that is capable of being integrated into a portion of the air mover and thus reduce the risk of loss of the connecting member. For example, at least a portion of an elastic member may be fastened to an exterior portion of an air mover or other drying device.

Air Filter and Chemical Injector

It is yet another aspect of the present invention to provide an air filter device that in some instances may interconnect with the air mover. More specifically, one or more air filters may be connected to an inlet of an air mover that may rely on the power and air flow associated with the air mover to cause the air to be drawn therethrough. The air filter may comprise attachment members for interconnection to the air mover, such as a flange or lip portion, which is located on or near an outlet. A filter housing, which is used to control air movement through the filter, may also be provided that allows for removal, and replacement of internal filter elements. The filter housing may also include clamps and other devices for securely attaching a filter to an air mover.

It is another aspect of embodiments of the present invention to provide an air filter that is capable of sanitizing, disinfecting, or freshening air. For example, ozone injecting devices may be included within the filter housing. Methods and devices for injecting ozone are described in, for example, U.S. Pat. No. 5,839,155 to Berglund et al., which is incorporated by reference in its entirety herein. Filter housing devices may also employ ultraviolet light radiation emission devices and chemical injection devices that sanitize or disinfect air, either before or after passing through one or more filters which may be part of the device.

Various embodiments of the present invention employ a filter device (or other devices) that dispels or atomizes the captured air to disinfect, freshen, or otherwise modify air. For example, an atomizer may be incorporated within an air flow path of a filter device, either within or proximal to the filter that offers a user the ability to selectively disperse various chemicals, cleaners, and/or fragrances to an area via the air flow produced by the filter device.

General Aspects of Embodiments of the Present Invention

It is thus an aspect of embodiments of the present invention to provide a method of remediating a water-damaged building, comprising: providing a self-contained power and control device; providing at least one drying component; providing at least one sensor; placing the at least one drying component in a water-damaged area of the building; connecting a power source to the power and control device; selectively directing the current received by the power and control device to at least one of the at least one drying component; providing drying criteria to the power and control device; gathering moisture content data from the at least one sensor; and using the drying criteria and the moisture content data to control the function of the at least one drying component.

It is another aspect of some embodiments of the present invention to provide a power and command device for use in remediating water-damaged buildings, comprising: a housing for electronic circuitry and componentry; a plurality of electrical power inlets integrated into the housing; a plurality of electrical power outlets integrated into the housing; a device for selectively directing power received from at least one of the plurality of electrical power inlets to at least one of the plurality of electrical power outlets; and a receiver for receiving data from at least one of a sensor and a drying component.

It is still yet another aspect of the present invention to provide a power and command device, comprising: a plurality of electrical power inlets; a plurality of electrical power outlets in communication with the plurality of electrical power inlets; and a means for selectively directing power received from at least one of the plurality of electrical power inlets to at least one of the plurality of electrical power outlets.

These and other advantages of the disclosed inventions will be apparent from the disclosure of the inventions contained herein. The above-described embodiments, objectives and configurations are neither complete nor exhaustive. As will be appreciated, other embodiments of the inventions are possible using, alone or in combination, one or more of the features set forth above or described in detail below. Further, the Summary of the Invention is neither intended nor should it be construed as being representative of the full extent or scope of the present inventions. Rather, the present inventions are set forth in various levels of detail in the Summary of the Invention, as well as, in the attached drawings and the Detailed Description of the Inventions and no limitation as to the scope of the present inventions is intended by either the inclusion or non-inclusion of elements, components, etc. in this Summary of the Invention. Additional aspects of the present invention will become more readily apparent from the Detailed Description, particular when taken together with the drawings.

BRIEF DESCRIPTION OF THE DRAWINGS

The accompanying drawings, which are incorporated in and constitute part of the specification, illustrate embodiments of the invention and together with the general description of the invention given above and the detailed description of the drawings given below, serve to explain the principle of these inventions.

FIG. 18 is a bottom perspective view of an impeller assembly used in the air mover of FIG. 14;

FIG. 19 is a top perspective view of the impeller assembly of FIG. 18;

FIG. 20 is a side elevation view of the impeller assembly of FIG. 18;

Figure 1:
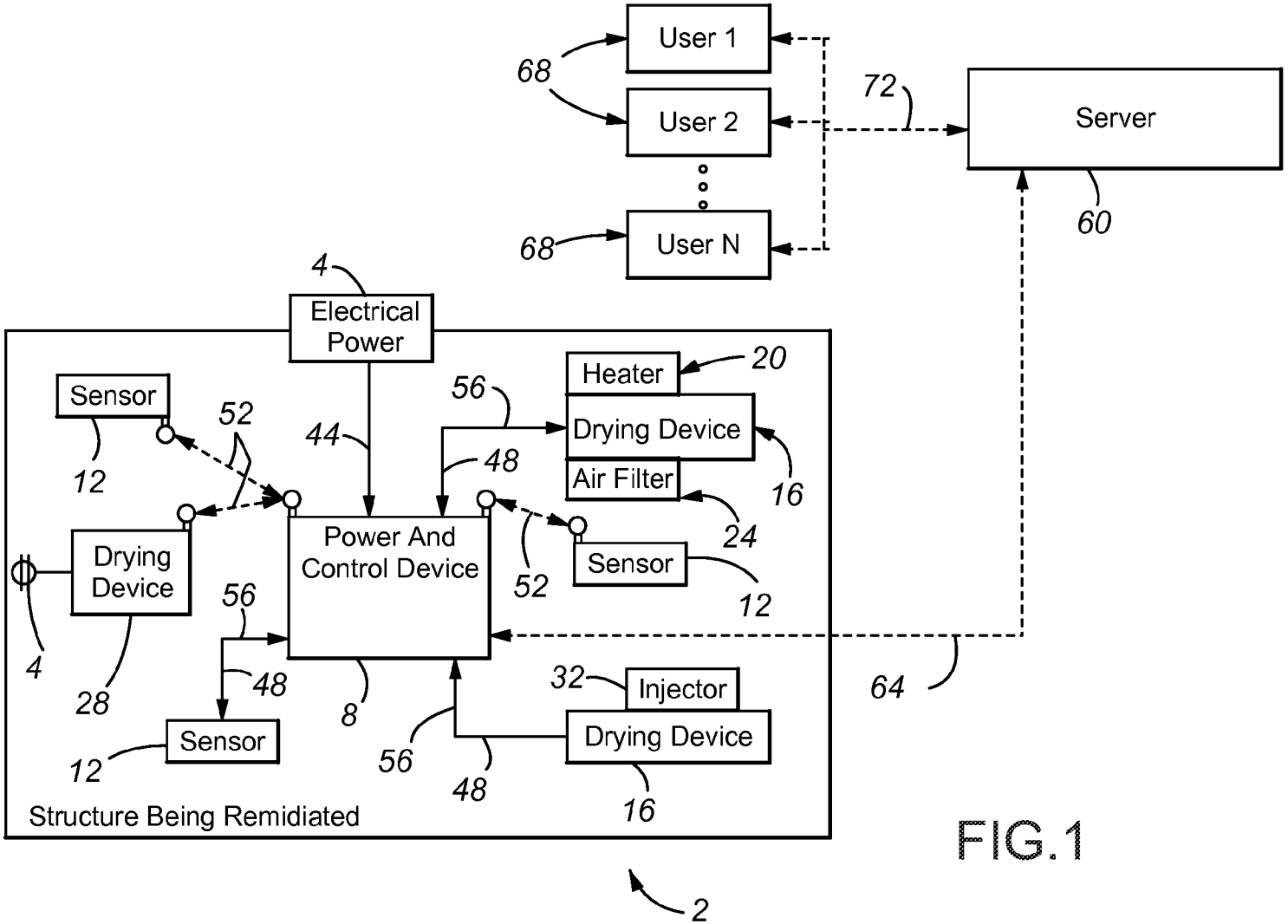
FIG. 1 is a schematic diagram showing overall operation of one embodiment of the present invention.

To assist in the understanding of one embodiment of the present invention the following list of components and associated numbering found in the drawings is provided herein:

| Component | # |
|---|---|
| Building | 2 |
| Electrical power | 4 |
| Control device | 8 |
| Sensors | 12 |
| Air mover | 16 |
| Heater | 20 |
| Air filter | 24 |
| Dehumidifier | 28 |
| Chemical injector | 32 |
| Wiring | 44 |
| Wiring | 48 |
| RF transmission | 52 |
| Communication protocols/devices | 56 |
| Remote hosted server | 60 |
| Internet communication system | 64 |
| Users | 68 |
| Internet | 72 |
| Front panel | 76 |
| Electrical power | 80 |
| Sockets | 84 |
| Knob | 88 |
| Sockets | 92 |
| Circuit breaker | 94 |
| Input buttons | 96 |
| Output device | 100 |
| Port | 104 |
| Back panel | 108 |
| Ethernet connection port | 112 |
| Frequency | 114 |
| Stop portion | 116 |
| Handle | 120 |
| Storage surface | 124 |
| Portable router | 128 |
| Cord | 132 |
| GFCI outlets | 136 |
| Primary sensor | 140 |
| Channel Switch | 144 |
| Power switch | 146 |
| Case | 148 |
| Aperture | 152 |
| Hook | 156 |
| Moisture sensor | 160 |
| Wire | 164 |

-continued

| Component | # |
|---|---|
| Housing | 168 |
| Metal penetrating members | 172 |
| Sill plate | 176 |
| Base board | 180 |
| Drywall | 184 |
| Inlet | 186 |
| Outlet | 190 |
| Housing | 194 |
| Lip or flange portion | 198 |
| Power cords | 202 |
| Power supply device | 206 |
| Handle | 210 |
| Base feet | 214 |
| Support feet | 218 |
| Louver | 222 |
| Apertures | 226 |
| Impeller | 234 |
| Motor | 238 |
| Motor stand | 242 |
| Fastening means | 246 |
| Elastic member | 254 |
| Projection | 258 |
| Lanyard | 262 |
| Pull tab | 266 |
| Pull tabs | 270 |
| Connecting member | 274 |
| Connecting member | 278 |
| Filter device | 282 |
| Inlet portion | 286 |
| Filter housing | 290 |
| Latch mechanism | 294 |
| Filter | 298 |
| Panel filter | 300 |
| Filter housing portion-hinged | 304 |
| Filter housing portion - buckled | 305 |
| Hinged arm | 308 |
| Filter stage | 312 |
| Filter stage | 316 |
| Retaining clips | 320 |
| Housing sealing element | 324 |
| Air mover sealing element | 326 |
| Clasps | 328 |
| Clamp | 330 |
| Attachment mechanism | 334 |
| Bracket | 342 |
| Screw clamp | 338 |
| Dehumidifier | 500 |
| Compressor | 502 |
| Evaporator | 504 |
| Discharge line | 508 |
| Condensor | 512 |
| Cool water from condenser | 516 |
| Catch pan | 520 |
| Expansion valve | 524 |
| Cold water hose | 525 |
| Hose | 532 |
| Tank | 536 |

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION

FIG. 1 depicts a general overview of major components that may be utilized with one embodiment of the contemplated remediation system. As can be seen, a building being remediated 2 typically will include various forms of electrical power 4. A power and control device 8, sensors 12, and several drying devices, which may include an air mover 16 (which may possess an integrated heater 20, air filter 24, or chemical injector 32), and a dehumidifier 28, are located within the structure 2. The drying devices may be connected to their own electrical power 4 and communicate with the power and control device 8.

Electrical power 4 is provided to the control device 8 through conventional wiring 44 from within the structure, such as 220 volt 30 amp or perhaps multiple of 110 volt 15 amp currents, or from another source, such as a portable gas powered electrical generator. The control device 8 may condition supplied electrical current to provide appropriate current to drying devices, such as air movers 16 or sensors 12. The required power in this configuration is supplied to such devices through conventional wiring 48.

The control device 8 collects data from the sensors 12, which can be stand alone devices, integrated into a drying device, or integrated into control device 8 itself. Information may be sent to and from some or all of the sensors and the control device via RF transmission 52 protocols or similar methods of communication. Sensors 12 can also communicate with the control device 8 via hard wire communication methods and devices 56. The control device 8 may send collected data to, and receives data or instructions from, a remote hosted server 60 via any appropriate communications network, such as a network using an RF router to supply information over an Internet communication system 64.

The communication network to be used by the system may be any combination of circuit switched, packet switched, analog, digital, wired and wireless communication equipment and infrastructure suitable for transmitting signals to the server 60. The communication network therefore may include one or more of the following: intranet, the internet, a cellular communication system, a wireless data system, a public switched telephone network, a private telephone network, a satellite communication system or point-to-point microwave system. Depending on the particular communication network utilized, the control device 8 may send signals in accordance with a wireless application protocol, FCC 802.11 standards, a proprietary protocol or other types of communication protocols.

An example of a suitable wireless link between the control device 8 and the communication network is a wireless internet link provided through a cellular service provider. The data message signals are routed to the hosted server 60 based on an IP address. The server 60 deciphers the incoming signals to extract the appropriate data. The drying procedure data is processed to generate drying procedure information that can be displayed or otherwise presented to interested parties through various user interfaces. The user interface could, but need not be, a web browser application running on a computer connected to the server 60 through the internet within the communication network. By designating the appropriate IP address, a user 68 can access the server 60 and view drying procedure information. Additional security and authentication mechanisms may also be utilized in some circumstances.

Control device 8 may use collected data and/or data received from the server 60 to adjust operating parameters of drying devices 16 and 28, heating device 20 and/or chemical injection devices 32. These operating parameters can be communicated in a binary or analog fashion and could include such actions as turning on or off power to a connected device or may be more sophisticated and include sending actual operating instructions to the device, utilizing wired and/or over the air techniques and/or protocols.

The host server 60 could include one or more input and output devices that facilitate bidirectional flow of information between the control device 8 and the server 60 and the server 60 and users 68 or other devices. The server 60 will have the ability to analyze data received from the control device 8, utilizing that data to generate reports and/or other appropriate content, messages or data. If data received from control device 8 indicates fault conditions at the site being remediated, alarms can be triggered at the structure being remediated 2, at the hosted server 60 or at another location and/or instructions can be sent where appropriate, such as to contractors in charge of the particular remediation project.

Users 68 can access server 60 in any conventional manner using any suitable communication device, including over the Internet 72 to constantly monitor their particular remediation project, access reports, request that certain drying equipment be disabled or that drying equipment parameters be adjusted, etc. Users 68 typically will not, however, through use of appropriate security software, be allowed to monitor data collected on other projects which may reside upon the accessed server 60.

In one embodiment of the inventions, users 68 utilize computers to access server 60. Those computers typically will include at least an output device, such as a video monitor or display, and an input device, such as a keyboard or computer mouse. Other types of input and output devices can be used in some circumstances. For example, the output device may include a speaker and the input device may include a microphone, a touch screen, joystick or touch pad. In accordance with known techniques, the computer will typically be connected to the internet 72. An example of a suitable connection includes establishing a communication link through an internet service provider and modem connected to a communication infrastructure, such as cable communication systems or packet switched telecommunication networks. In some circumstances, other techniques could be used to establish a communication link with server 60. Other suitable communication links could include wireless communication links using WAP or WiFi connections and computer network connections, such as Ethernet and token ring systems, for example.

In an exemplary embodiment, a wireless communication system could include a cellular telephone system with packet switched mobile data capabilities, such as ARDIS, RAM, or CDPD services. As is known, the systems provide a communication data packet formed off line and a header and error correction that is added prior to transmission. A dedicated communication link, therefore, is not utilized in the exemplary embodiment. In some situations, a circuit switched dedicated communication link may be used. For example, a dial-in wireless internet connection service over the cellular telephone system can be used for the wireless communication link. Some wireless communication systems, for example, provide wireless internet access with the user of a wireless modem that can be connected to a laptop computer or personal digital assistant. The wireless communication system may utilize any communication protocol and modulation, such as, for example, code division multiple access (CDMA), time division multiple access (TDMA), advanced mobile phone service (AMPS), general packet radio service (GPRS) or global system for mobile communications (GSM) in accordance with known techniques.

The wireless communication system also could forward data through the internet, and possibly other communication networks, to the server 60. In some circumstances, a cellular voice channel may be used to transmit data to the server 60. In such a circumstance, the monitoring device or the control device 8 typically will establish a cellular call with a modem connected to the server 60, either directly or through a network. The call can be transmitted after data has been transferred and reestablished as needed or it may be maintained throughout the remediation process. One of skill in the art will appreciate that operators may utilize smart phones to monitor the control devices and/or modify its operating parameters.

Power and Control Device

Figure 2:
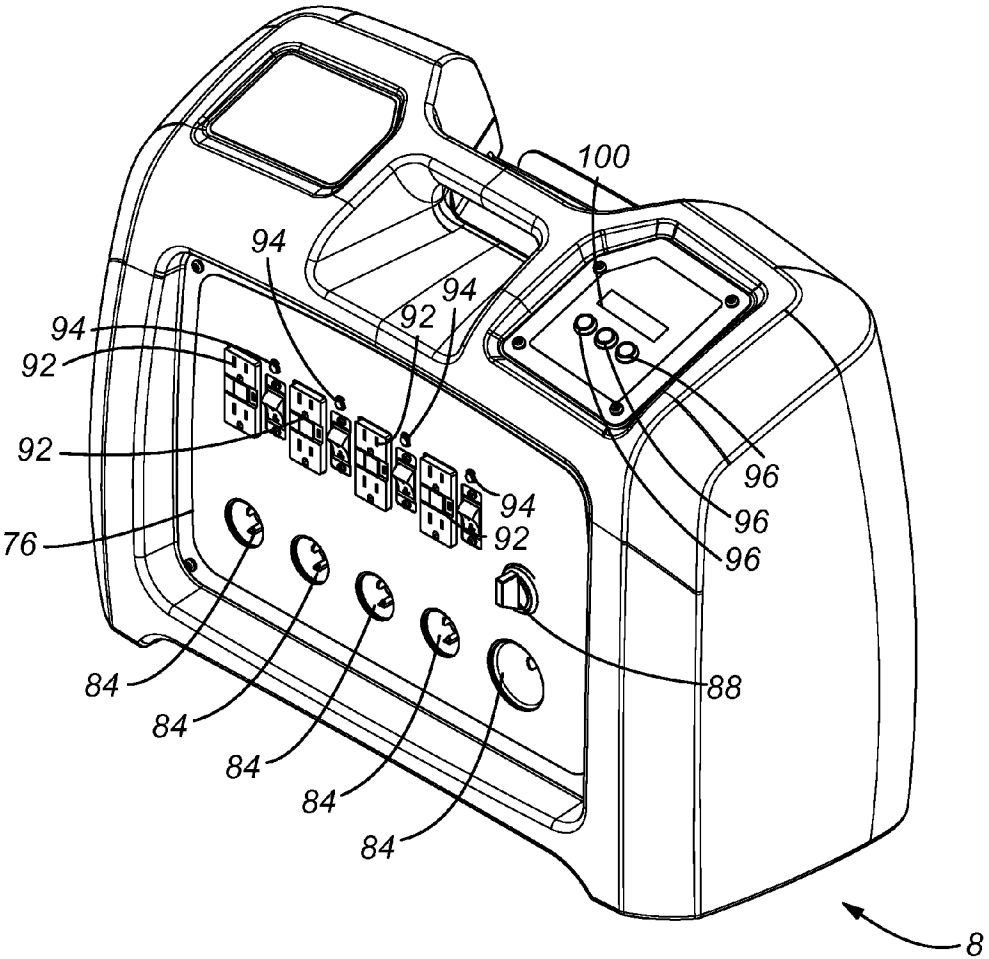
FIG. 2 is a front perspective view of a power and control device of one embodiment of the present invention.
Figure 3:
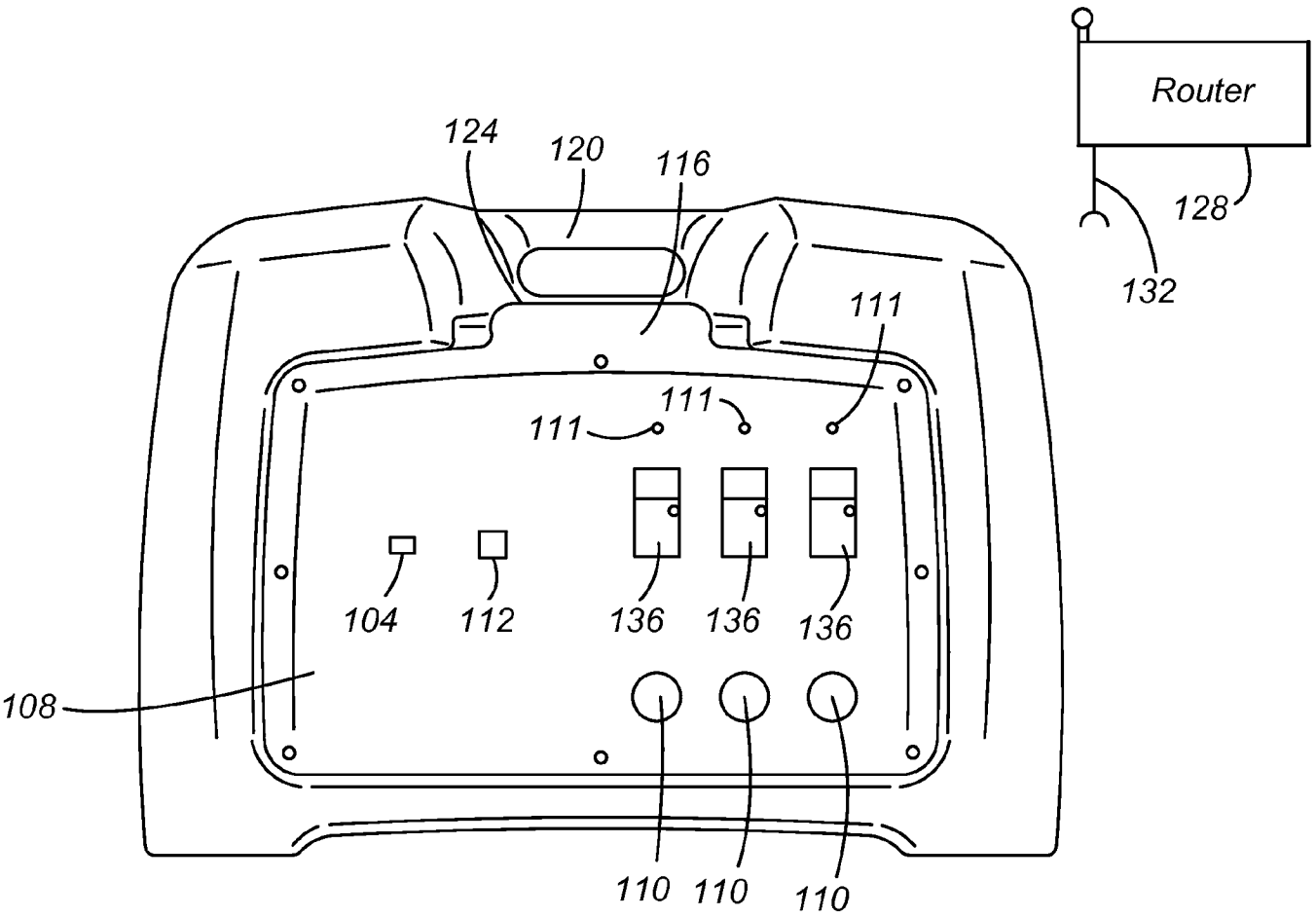
FIG. 3 is a rear elevation view of the power and control device.
Figure 4A:
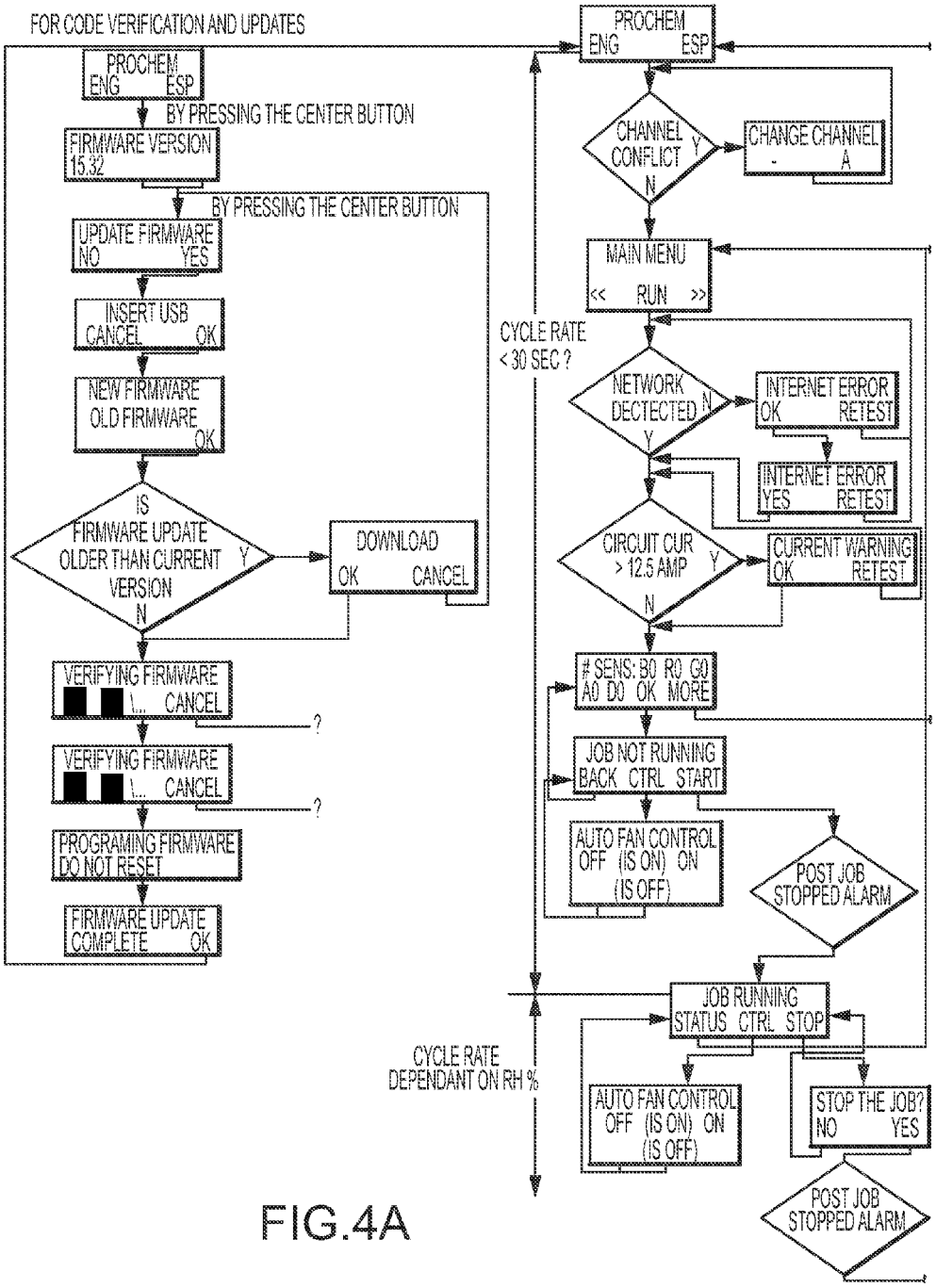
FIGS. 4A-4E shows a preferred menu set up flow chart of one embodiment of the present invention.
Figure 4B:
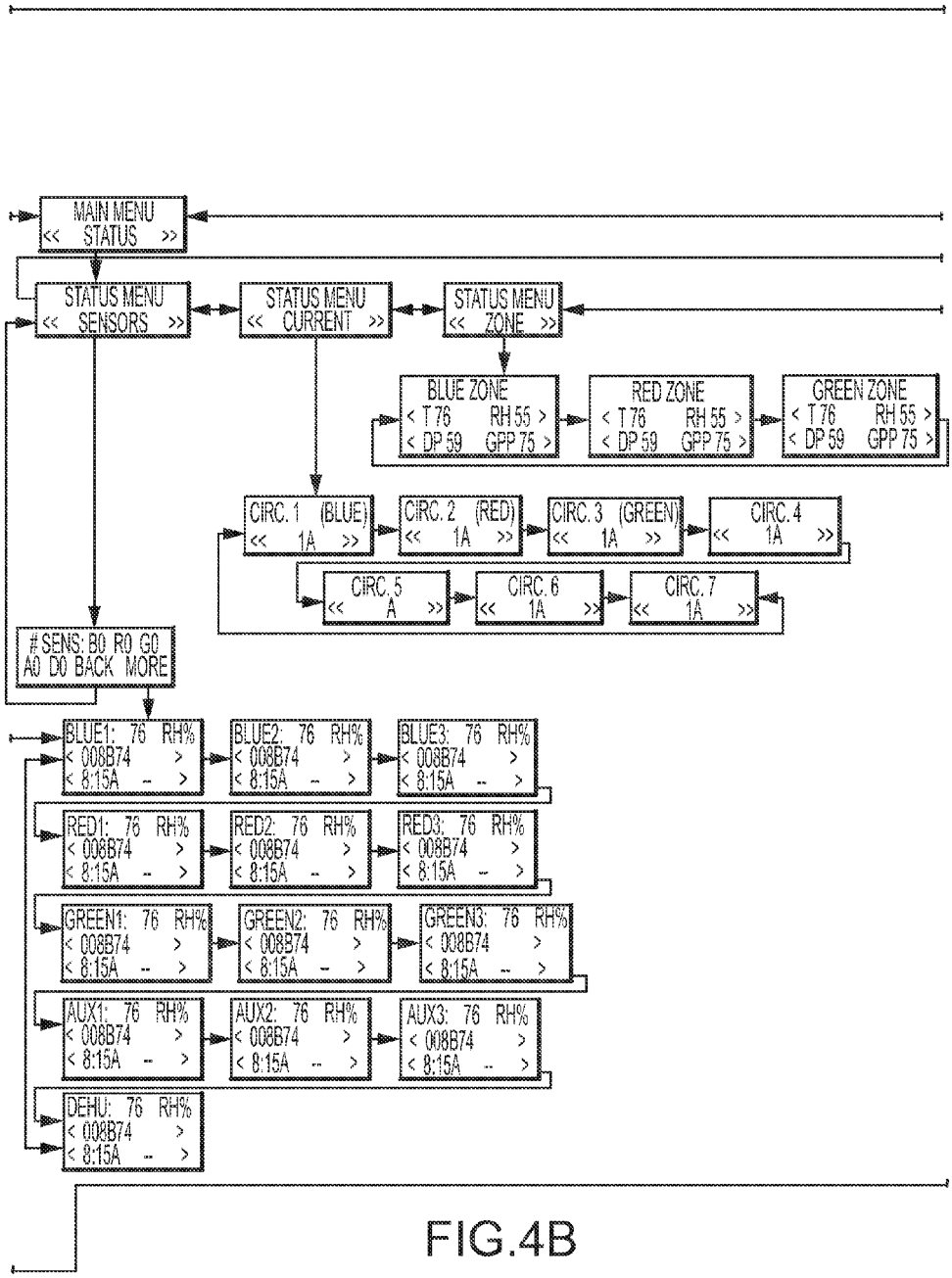
Figure 4C:
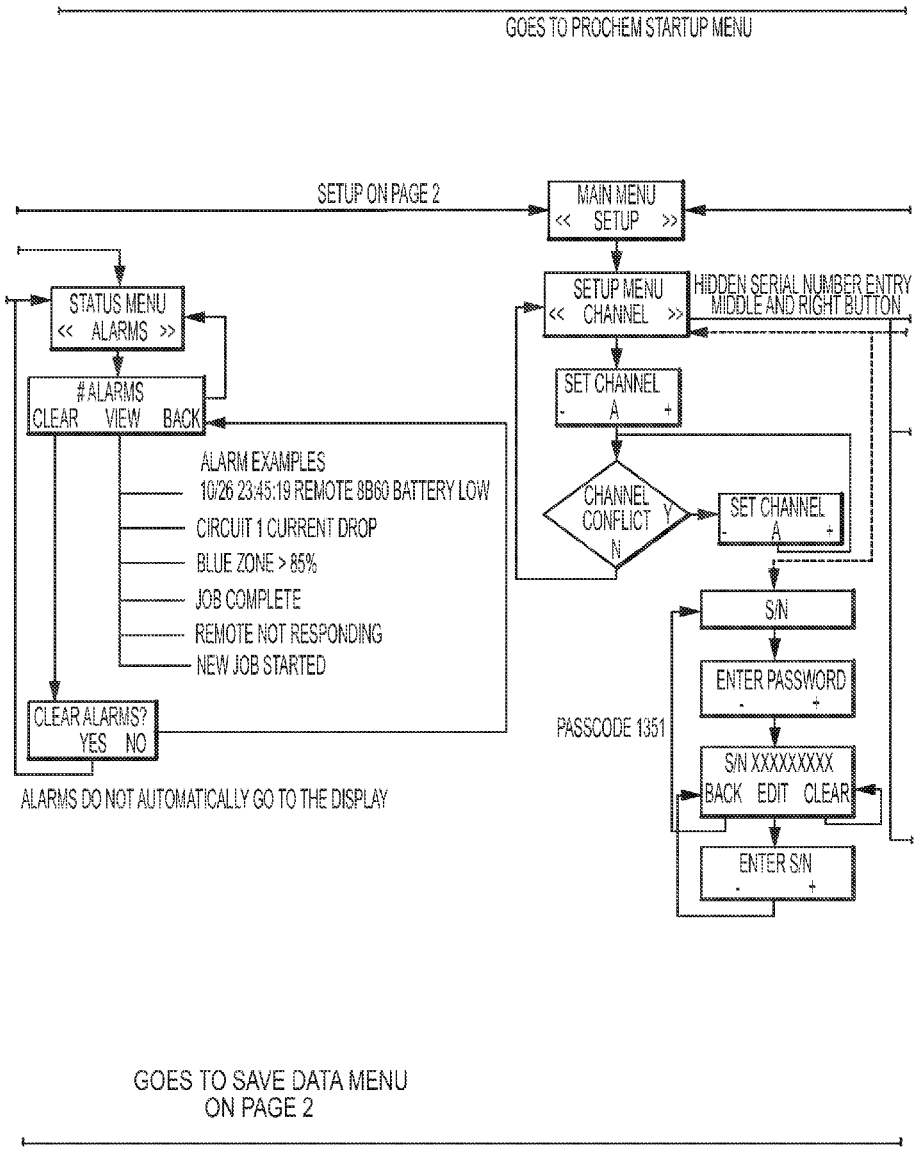
Figure 4D:
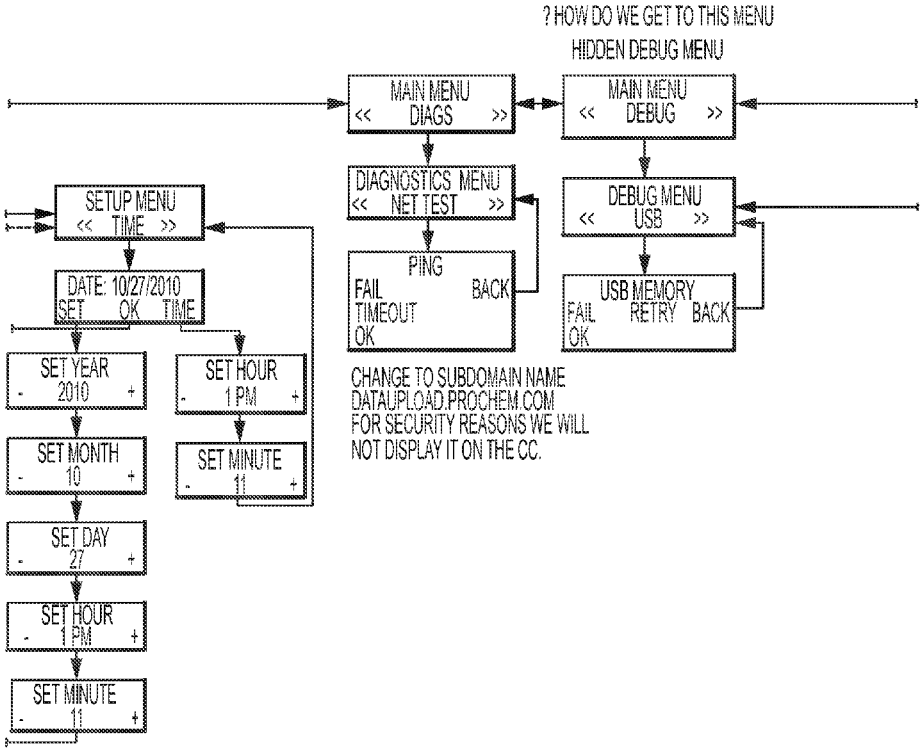
Figure 4E:
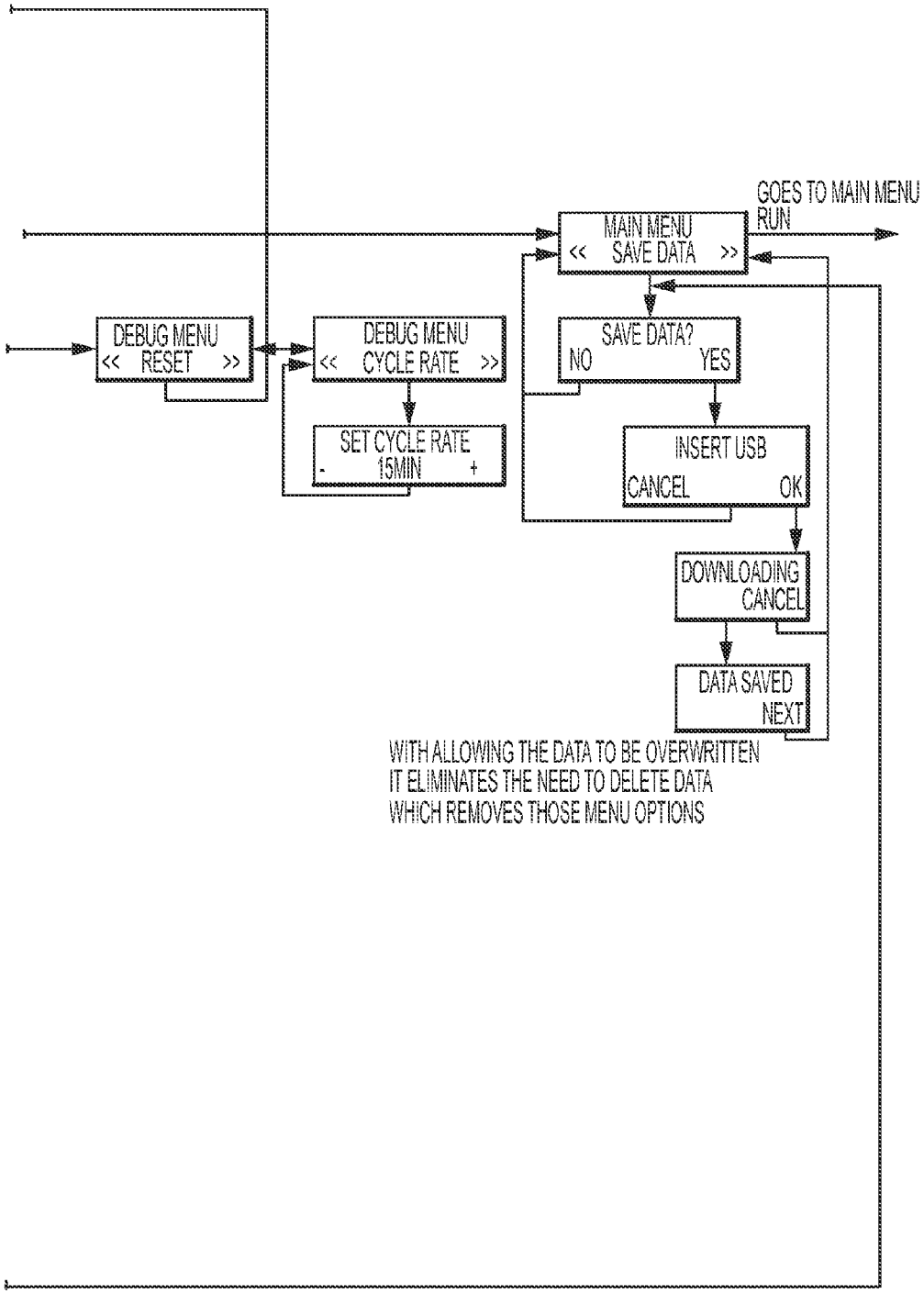
Figure 5:
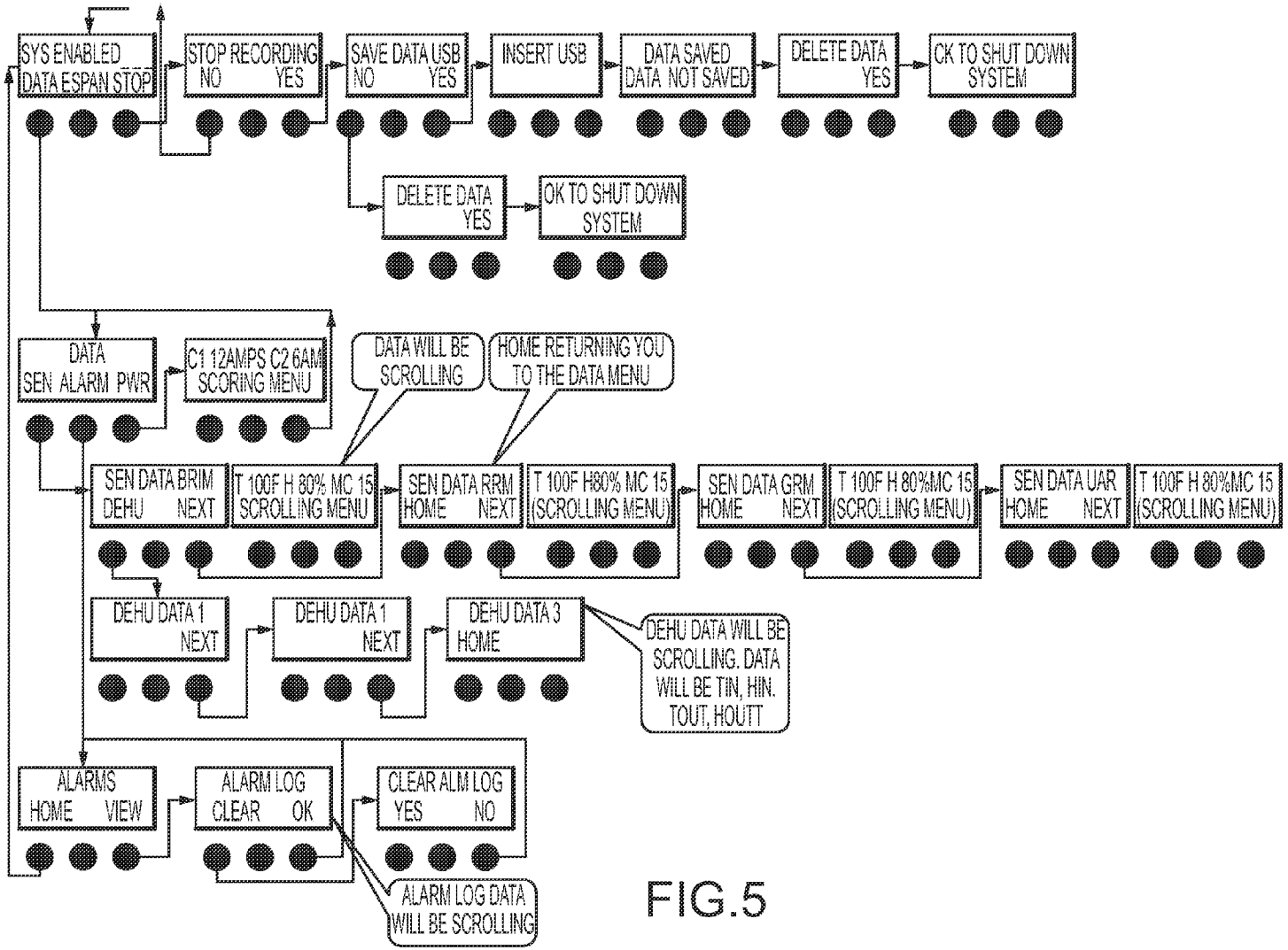
FIG. 5 is a schematic of process flow of one embodiment of the present invention.

As shown in FIGS. 2-3, the power and control device 8 is comprised of a self-contained, rugged, and substantially fluid impermeable outer case that safely and securely houses various electronic circuitry. The case is preferably comprised of roto-molded polyethylene that is rigid and not prone to damage from contact with fluid. Also, the case does not damage the work site as it does not leach material (rust) contaminants, even when its base is immersed in fluids for a prolonged period of time. Metal panels may preferably be affixed to the roto-molded case at the front and rear. The internal power and other components of the control device 8 are assembled and affixed to these panels. Those subassemblies are next bolted into the case to create the final power and control device 8.

The control device 8 includes five major components: power collection and distribution related circuitry and componentry; circuitry and componentry to collect data from sensors and to transmit data to drying equipment; circuitry and components to transmit data to and receive data from a remote server; components to aid in the proper installation and set up, monitoring and control of drying equipment to be placed in a structure; and a power supply.

The power supply used in the control device 8 of some embodiments is an off-the-shelf unit manufactured by TDK Lambda Americas, Inc. and sold under the Model Number MTW15-51212. The power supply receives 8 volts AC, converting that power into three separate DC voltages: 12 volts DC; 5 volts DC; and 3.3V comes for regulation on the main board. The 3.3 volt DC power is designed to operate the radio frequency engine of the control device 8; the 5 volt DC power is used to power the input/output circuitry of the control device 8; and the 12 volt DC power is used to power the remainder of the circuitry included within the power and control device 8.

The front panel 76 of control device 8 accommodates a plurality of electrical power sockets 84. The sockets 84 accept 110 volt, 15 amp electrical current or 220 volt, 30 amp electrical current. Knob 88 can be used to select the current type that is being input into sockets 84 positioned on the front panel 76 of the control device 8. The knob 88 can be turned to one of three positions: the off position, wherein no power is being allowed to travel from any of the sockets 84 into control device 8; a 110 volt position wherein 110 volts of power is being supplied to one, some, or all sockets 84; or the 220 volt position, wherein 220 volts of power is being supplied to one, some, or all sockets 84 If the knob 88 is positioned to the 110 position and 220 volt current is supplied to outlet 84, the control device 8 splits the incoming power equally between two GFCI electrical outlets 92. Each of the GFCI outlets 92 are circuit-breaker 94 protected and may receive a power cord associated with any electrical equipment, such as drying devices.

Each of the GFCI electrical outlets 92 may be selectively deactivated by control circuitry included within control device 8. A person of skill will understand that a controller may send a signal that will cause a relay and related circuitry to either apply or remove power from sockets 92. One or more of the sockets 92 may not be under the control of a controller 8.

The control device 8 also includes set up, monitoring and control circuitry. The circuitry may include volatile memory, non-volatile memory upon which firmware may be stored, a main processor and controller and a RF engine. All of the circuitry may be housed on a single PCB and the RF engine is comprised of a SNAPSE all-in-one module, Model Number RF100PC6. The RF engine, which interacts directly with the controller 8, preferably operates on a frequency of 2.4 GHz and preferably utilizes SNAP mesh network technology to provide self-forming and/or healing node integration. The PCB also preferably accommodates, among other componentry, memory devices, a debugging USB port, RF engine interface circuitry, voltage regulation and processor configuration power on reset circuitry, battery backup circuitry, interface-to-power control board circuitry, Ethernet interface circuitry, and external S-RAM and operational panel interface circuitry.

The control device also may monitor current draw which will aid the user in system operation. For example, if more than 15A are sensed, the user will know that there is an error in the system. Also, the user can set the controller 8 to monitor for a specific current range that will indicate a potential system error, such as 12-15A current draw.

The power and control device 8 also includes an input and output device that interacts with the main controller board and includes input devices 96 and an output device 100. An input/output circuit allows the user to input operating information into device 8 via buttons 96. Information uploaded into control device 8 is preferably stored in non-volatile memory. Information relevant to a remediation project may be displayed on the output device 100, which may be an LCD screen.

Using input buttons 96, a contractor can upload site-specific drying parameters and/or information into device 8 that can then be used to control, configure, etc. sensors and/or drying equipment, among other things. For instance, starting with a setup mode, after selecting a specific channel (i.e., channel A, B or C), the control device 8 will automatically display sensor information, that is linked to a specific remediation zone, such as a red zone, a blue zone, or a green zone. Zones are not related to the channels. Zones are related to the colored circuits. However they are not part of the display setup process. The end user has to make this connection himself. If the displayed sensor information shows a different configuration than was actually set by the user, then a few help screens may come up in the display device to aid with solving the problem. If the sensor information displayed is correct, the system displays all of the sensors with which it is communicating. If that information is correct, the system operator can move on to the next menu. If not, a help screen is available to help the operator solve the problem.

After the operator is satisfied with the sensor setup, a current menu is typically displayed. That menu will show the total number of circuits which are being supplied with current and thus operational within the power and control device 8. If more operational detail is required, the operator can press an information button to obtain actual current that is being drawn on a particular circuit located within the power and control device 8. Next, the system automatically will check for an Internet connection. If an Internet connection is located, the device will automatically move to the next menu screen. If not, typically and a few help screens will be available to help resolve the problem. Finally, the system operator must make a decision as to whether the control device 8 will shut down the circuits when the dew point of the remediation zone is approaching optimal. Once that decision is made, the remediation job can be started with the control device 8 being in control.

A setup menu structure of one embodiment is shown in FIGS. 4A-E. The startup menu of this embodiment allows the user to start a remediation task with a minimum interaction. More specifically, it is contemplated that four buttons be pushed to initiate startup. In addition, three automatic system checks are contemplated, the progress of which can be accessed by the user. Generally, unless there is an operation issue, the end user will not have to access menus related the system checks. The user can obtain more information about the system by way of a general status menu.

In operation, the main processor accepts data received from sensors, drying devices, the remote server and/or the contractor, and can direct and control certain actions to be undertaken by drying devices, the contractor, etc. During operation of the overall system, data concerning environmental conditions will periodically be processed by the main processor. Typically, and preferably, three different readings of temperature and humidity will be utilized and averaged to calculate a dew point per area. The control device 8 may shut down devices connected to some or all sockets 92 when a desired dew point value is being approached in a given remediation environment. For instance, if average temperature and perhaps other parameters being recorded by the control device 8 are within an appropriate range of a desired dew point, a circuit shut-down command could occur. At this point, a controller will send a signal to a relay, causing one or more of sockets 92 to be deprived of power. Typically, air movers will be plugged into these sockets, thus causing the air movers to discontinue operation. When shut down occurs, alarms can be sounded and/or alarm messages sent to various individuals and devices etc. The sockets 92 could be reenergized as desired by the controller 8.

The sensors can easily be calibrated or "zeroed" to a particular value, through use of correction factors stored at the main processor. Specifically, upon startup, the control device 8 will obtain information from all sensors in a given remediation zone. If those sensors are not each registering environmental variables at the same value, the environmental readings can be adjusted in various ways known in the field within the control device 8. These adjusted values can then be used to make necessary future remediation calculations without actually recalibrating in the field each sensor.

The RF engine is preferably capable of analyzing, converting to a digital format (if necessary) and processing data collected and forwarding that information to the main processor. The data to be sent may have a unique format, beginning with a unique identification number such as a MAC number, then sensor location identification information, followed by temperature and humidity value information, and then a moisture content value and finally battery level information. As those skilled in the art will realize, the information sent could be different, sent in a different order, expanded, contracted, compressed, etc. Also, the data could be sent constantly or only when the sensor is interrogated by the power and control device 8 or on some other schedule or occurrence. The RF engine also is designed to accept data sent from the main processor and to configure that data for transmission to sensors, drying equipment, etc.

The RF engine of one embodiment is capable of collecting and transmitting data over many, for example at least three, frequency ranges. By the use of these unique frequency ranges, a contractor can use a single device 8 to communicate with multiple different sensors and/or drying devices within a remediation structure, and have each of those devices or series of devices be performing different functions and/or operating synergistically in different areas of the structure being remediated. One embodiment of the invention preserves battery life by determining recording frequency periodically by Rh factor. For example, if the Rh factor is greater than about 60%, frequency is reported about every 15 minutes. If the Rh factor is less than about 60%, the frequency is reported about every one hour.

With specific reference to FIG. 3, a back panel 108 of control device 8 is shown. In one embodiment of the control device 8, three sockets 110 are shown that preferably accept 110 volt, 15 amp current. That current is supplied to three circuit-breaker 111 protected 110 volt GFCI outlets 136. In one embodiment, these outlets are not under the control of the main processor. Although not controlled, these circuits preferably are current monitored. A USB connection port 104 is also provided on back panel 108 that is in electrical communication with the main processor and can be used to download data collected by sensors or upload data to the main processor and from sensors, digital equipment, the server, etc. Obviously, virtually any form of data port could be used in place of the USB port 104.

The back panel 108 also includes an Ethernet connection port 112, which is also in electrical communication with the main processor. Among other things, the Ethernet port 112 may be used to facilitate data transmission between device 8 and remote server 60. For instance, port 112 could be appropriately connected to a hard-wired network, an RF transceiver or other over-the-air data transmission systems.

In one embodiment, device 8 is configured with a stop portion 116 of back panel 108. Between stop portion 116 and handle 120 of device 8 is a substantially flat storage surface 124 that may receive a portable router 128, using a cellular data card or other appropriate device. The router 128 may be battery powered or it could be powered through cord 132, which could be plugged into any of the powered GFCI outlets 136. Using a suitable patch cable, data may be transmitted from the main processor through either Ethernet port 112 or USB port 104 to the router 128. That data may then be transmitted over the air to the remote server 60 or other appropriate device(s). By utilizing an external router, as opposed to incorporating a data router into device 8 itself, the overall flexibility of controller device 8 may be enhanced and the cost thereof decreased. Obviously, however, the router could easily be made integral with the controller 8.

Figure 6:
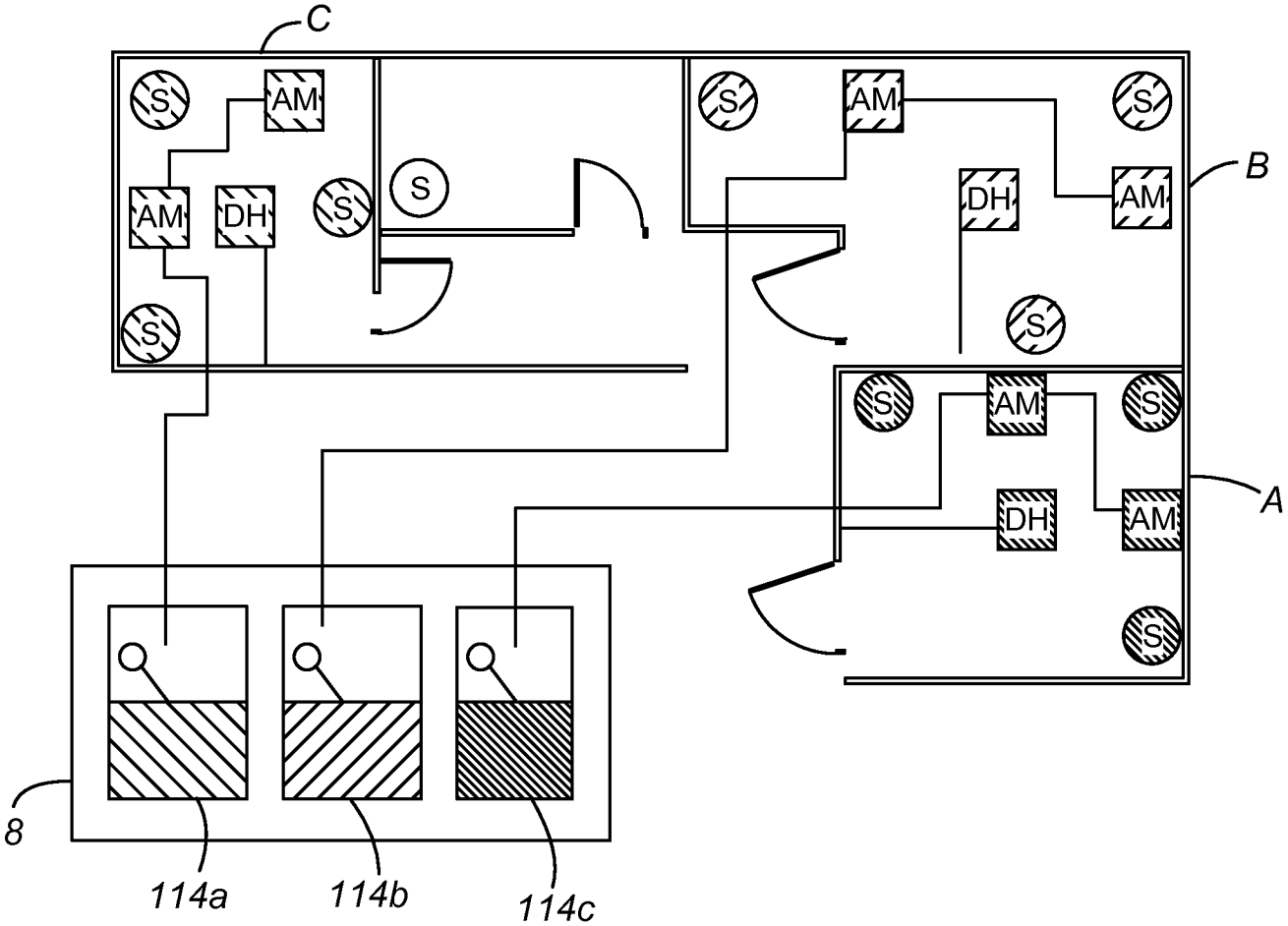
FIG. 6 is a typical three room layout of a one level structure showing how the power and control device of one embodiment of the present invention could be utilized to simultaneously control three different drying regions within the structure.

As shown in FIG. 6, a single control device 8 could be used to monitor and control three separate drying zones, A, B and C. As explained, a single control device 8 may operate on three different radio frequencies. For purposes of this disclosure, "frequency" may mean "channel" and vice versa and should be understood to include virtually any system, parameter, etc. Sensors ("S"), air movers ("AM"), dehumidifiers ("DH") and other equipment may selectively be keyed to one of several available frequencies. Specifically, data sent by sensors using frequency 114A are recognized by control device 8 as having come from only those sensors in zone A when device 8 is also set to zone A. A second frequency 114B in the control device 8 may be set to a second frequency. Again, sensors, air movers and dehumidifiers and perhaps other drying equipment in zone B may be keyed to that frequency. When those devices send data to the control device 8, it is sent on the zone B frequency and is thus recognized by the control device 8 as coming from those particular sensor devices. In that way, the control device 8 can optimize the drying procedures in a given area with exacting precision. The control device 8 also can operate in a third frequency 114C, again with sensors and drying devices being keyed to that frequency, as shown in zone C. As will be understood by those of skill in the art, by utilizing a single control device 8 operating on three or more different frequency ranges, it is possible to achieve great efficiencies and precision in remediating compartmentalized structures.

In a second embodiment, each device capable of sending data to power and control device 8 is assigned a unique identification number. Upon configuration of the sensors and/or drying devices in a single unique drying area of a structure, those devices' unique identification information may be registered with control device 8. In this way, the control device recognizes devices installed in a particular drying zone and may thus efficiently control the drying parameters in that unique area. The identification and pairing process can be repeated for other unique drying areas, with the total number of unique drying areas only being limited by the computing power and memory of control device 8.

In one embodiment, each of the controlled outlets 92 of power and control device 8 are colored differently, typically red, blue and green. Sensors may similarly be colored and thus coordinated with particular outlets. Some auxiliary sensors which may be colored black, may be placed in unaffected locations and used for control data. Finally, each of the coordinating colors can be assigned to one of three unique control channels recognized by power and control device 8. Through the process of color coding, a user can easily set up various drying zones and be certain that the setup process has been performed appropriately.

Figure 7:
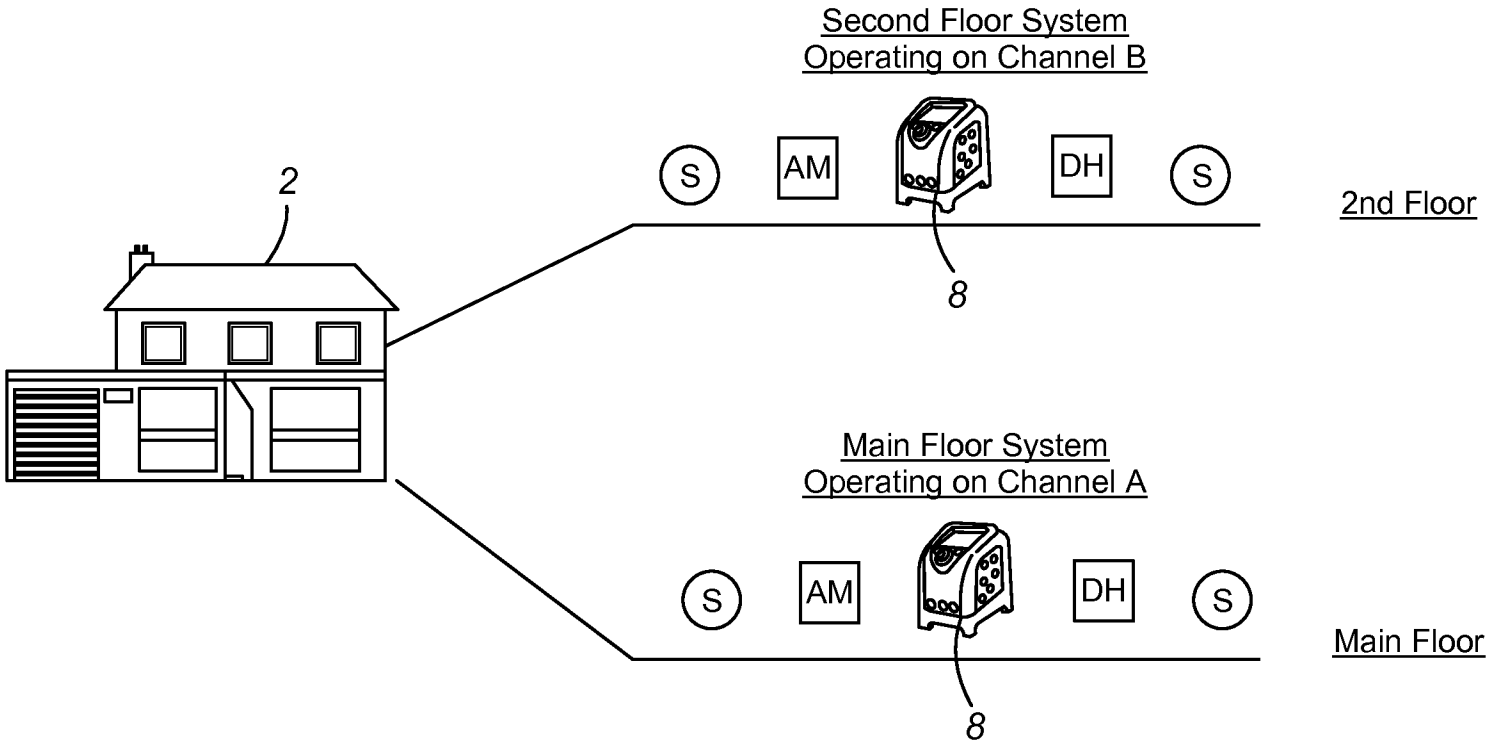
FIG. 7 depicts a multi-level structure and the layout of two power and control devices that can be utilized to remediate different floors of that structure.

In another embodiment, a contractor may use multiple control devices 8 in a single structure being remediated. As shown in FIG. 7, two control devices 8 are utilized in a single wooden structure. One control device 8 is utilized in the upper portion of the building, while the second control device 8 is used in the lower section of the building. Each of the devices can operate on different frequencies, thus allowing each device to control equipment located on their particular floor efficiency and effectively by keying the sensors and drying devices to an appropriate frequency. In a further embodiment, each of the control devices could utilize three separate frequencies, none of which are overlapping. In this scenario, two control devices 8 could actually operate multiple different remediation zones effectively and efficiently within a single structure.

System Sensors

Figure 8:
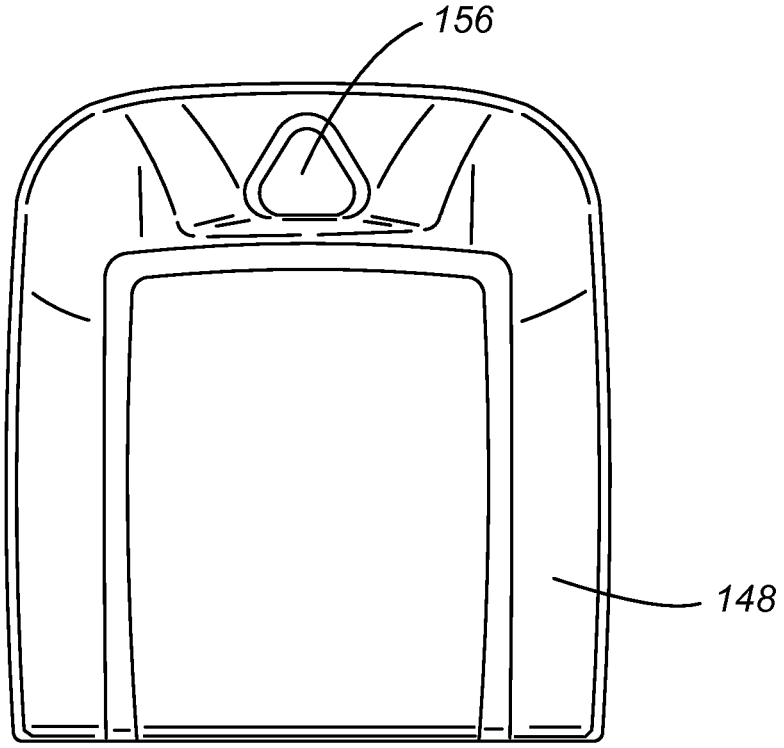
FIG. 8 is a front elevation view of a primary sensor of one embodiment of the present invention.
Figure 9:
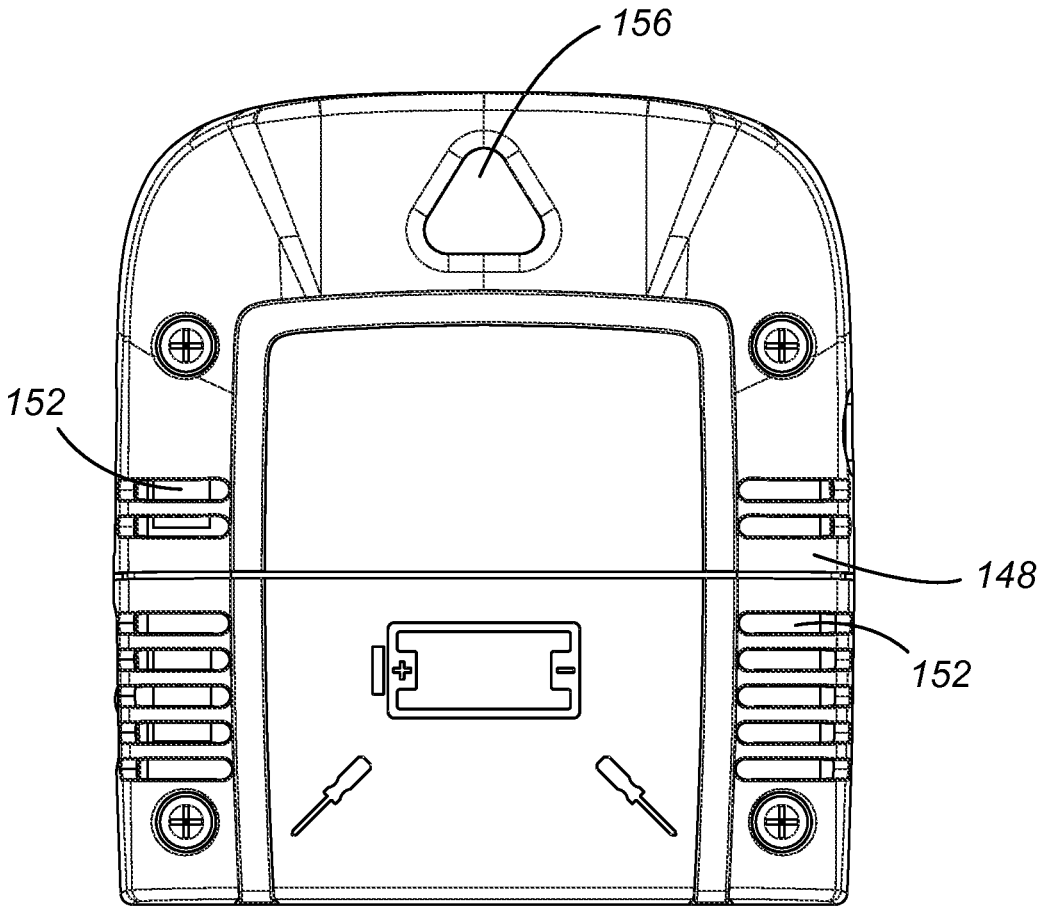
FIG. 9 is a rear elevation view of a primary sensor of one embodiment of the present invention.

The remediation system of one embodiment of the disclosed invention may utilize two types of sensors. A primary sensor 140 shown in FIGS. 8-10 that are preferably individual battery-powered devices that monitor relative ambient humidity and ambient temperature. That data, along with a low battery signal and moisture content information may preferably be transmitted, via an RF transponder or other appropriate over the air transmission device, to the control device 8. The frequency or channel (A, B or C) through which data will be transmitted can be set utilizing switch 144 shown in FIG. 10. Switch 146 is a power switch for turning the sensor 140 on or off.

All the temperature and humidity sensors and electrical componentry of the primary sensor 140 is enclosed within a moisture-permeable case 148. Ambient air enters the case 148 through a plurality of apertures 152 (FIG. 9) and comes in contact with the temperature and humidity sensors that are housed within the case 148. The primary sensor system 140 may be placed within a structure being remediated preferably using an integral hook 156.

It has been recognized that wood-framed structures are one of the more difficult structures to remediate. One of the reasons for this difficulty is that many different materials are often layered over each other in typical wood constructions. Measuring the moisture content of the integral wood located at the base of a wall, typically referred to as a "sill plate" in wood structures, can accurately predict complete drying of all of the other materials in the wall. It is known that wood cannot typically saturate beyond a 25% to 30% total moisture content and that the percentage of moisture captured within wood can be determined by measuring electrical resistance of the fluid-affected wood. The tables provided above outline the approximate percent moisture content of wood with respect to measured resistance. Accordingly, by measuring electrical resistance present in a sill plate, one can determine the moisture content of that wood and thus estimate the overall moisture content of other materials located within the structure being remediated. A second type of monitor to be used in embodiments of the present invention takes advantages of these concepts and findings. More specifically, sensors 160 (FIGS. 11-13) may be provided that include all of the componentry of the primary sensor along with a penetrating moisture content sensor.

One embodiment of the present invention provides a table that is used by the sensor, or the user thereof, to ascertain the moisture content of wood. More specifically, it is known that for a given time constant and moisture content, wood will exhibit species-specific resistance values. For example, assuming the time constant is 16.67, a Douglas Fir having 7% moisture content will yield 22,400 megaohms of resistance. Douglas Fir having a 25% moisture content has a resistance of 0.46 megaohms. By contrast, Black Ash has a resistance of 14,000 megaohms at 7% moisture content and a resistance of 0.17 megaohms at 25% moisture content. The resistance vs. moisture content values associated with various types of wood vary dramatically as described in "Electric Moisture Meters for Wood", William L. James, U.S. Department of Agriculture, General Technical Report FPL-GTR-6, 1988, which is incorporated by reference in its entirety herein. In an effort to identify resistance values that could be used to measure the moisture content regardless of wood type, the formula outlined above, TC=16.67 RC, was modified to normalize species-specific data. Thus, the sensors of one embodiment of the present invention uses a formula wherein the resistance values of the various wood types was raised to the 0.3 power, that is:

$$R=(TC/0.67C)\hat{}0.3.$$

Revisiting the example provided above, the normalized resistance value for a Douglas Fir at 7% and 25% moisture content under the above referenced formula is about 20.187 megaohms and 0.792 megaohms, respectively. With respect to Black Ash, the resistance associated with the moisture content of 7% and 25% is about 17.532 megaohms and 0.588 megaohms, respectively. When resistance values vs. moisture content of various species of wood, including Douglas Fir, Sugar Pine, Calif. Red Fir, Sitka Spruce, Western Hemlock, White Pine, White Fir, Long leaf Pine, Short Leaf Pine, Ponderosa Pine, Western Larch, Jack Pine, Black Spruce, Red Pine, Eastern Hemlock, Black Ash, White Ash, Big Tooth Aspen, Basswood, Birch, Paper Birch, American Elm, Hickory, Khaya, Magnolia, Mohogany, Sugar Maple, Northern Red Oak, White Oak, Philippine Mohogany, Sweet Gum, Black Tupelo, Black Walnut and Yellow Poplar, were compiled using the above referenced formula for moisture contents arranging from 7% to 25%, average resistance values were obtained that are independent of wood type. The table below is used by sensors to correlate measured electrical resistance to moisture content percentage regardless of the wood being tested.

| R(MΩ) | % MC |
|---|---|
| 0.810 | 25 |
| 0.875 | 24 |
| 0.954 | 23 |
| 1.049 | 22 |
| 1.164 | 21 |
| 1.306 | 20 |
| 1.476 | 19 |
| 1.678 | 18 |
| 1.932 | 17 |
| 2.244 | 16 |
| 2.645 | 15 |
| 3.157 | 14 |
| 3.823 | 13 |
| 4.747 | 12 |
| 6.024 | 11 |
| 7.946 | 10 |
| 11.086 | 9 |
| 16.643 | 8 |
| 24.533 | 7 |

This data is used by the sensors to enhance the overall universal functionality of the sensors and the system.

Figure 10:
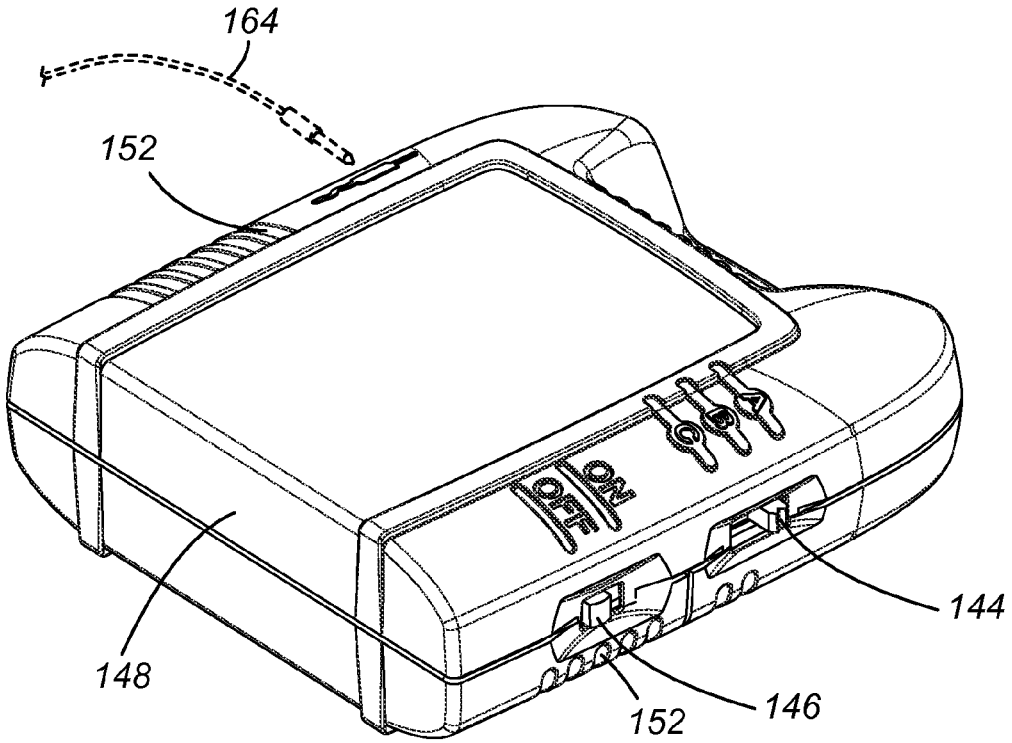
FIG. 10 is a perspective view of a primary sensor of one embodiment of the present invention.
Figure 12:
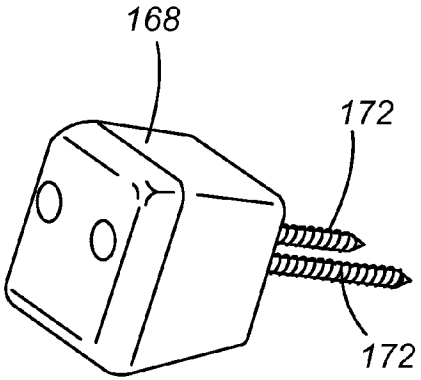
FIG. 12 is a front perspective view of the penetrating sensor.
Figure 13:
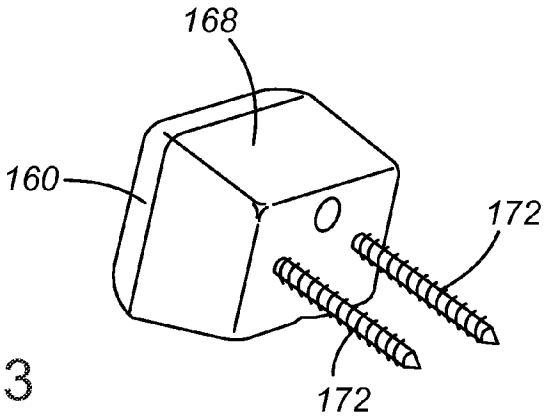
FIG. 13 is a rear perspective view of the penetrating sensor.
Figure 11:
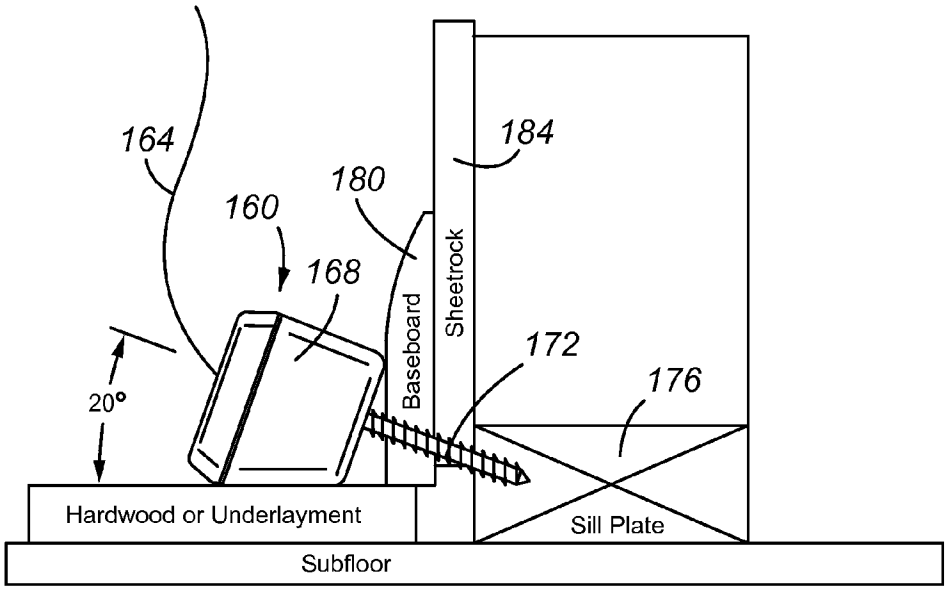
FIG. 11 is a penetrating moisture sensor of one embodiment of the present invention as installed in a section of a structure to be remediated.

As shown in FIGS. 11-13, a battery-operated penetrating moisture sensor 160 of one embodiment of the present invention is in electrical communication with the primary sensor via wire 164 that plugs into the primary sensor via a plug as shown in FIG. 10. The sensor 160 could also be powered from primary sensor 140 or other available power source. As one of skill in the art will appreciate, the penetrating moisture sensor 160 could alternatively communicate with primary sensor 140 via various over-the-air communication techniques. Data collected by the penetrating moisture content sensor 160 may be communicated to control device 8 through the RF transponder included within the primary sensor or through a separate transmission system.

The sensor 160 preferably includes a housing 168 and two penetrating members 172, such as nails, screws, etc. The housing 168 preferably has an angled geometry which, as shown in FIG. 11, facilitates its ease of use and installation into a sill plate 176 through a base board 180, and drywall 184. Specifically, the housing 168 includes sloped side walls that naturally place penetrating members 172 at an angle. During installation, a contractor simply needs to place the sensor 160 on the floor, driving the penetrating members 172 through base board 180, drywall 184 and/or any other material and into the sill plate 176. Moisture content of the sill plate wood 176 is measured by reading the resistance to current flowing between each of penetrating members 172.

In one embodiment, a 7555 C-MOS RC timer is used along with other componentry to estimate the moisture content of the sill plate. The timer is set up as a monostable (one-shot) circuit. When the timer is triggered, the output of the timer is set to a high state. The output remains in the high state while the capacitor charges through the moist wood. When the capacitor has reached its charge point, the output is set to a low state. The charge point is lowered by placing a voltage on the control input. This changes the TC formula described above to about 0.67 RC. That is, the "on time" is the time the output remains high and the time constant is represented by the formula TC=16.67 RC. Since the "on time" (TC) is known and the capacitor value is known, the resistance of the wood can be calculated.

The triggering and TC values are preferably measured using the RF engine present in the primary sensor. The TC value may then be sent back to control device 8 to calculate the resistance value, which is used by the main processor of control device 8 to estimate the total moisture content of the sill plate wood. Once the sill plate wood reaches approximately 8% moisture content, the structure may be considered dry and a remediation complete signal can be generated and sent to any number of locations, including a communication system of a contractor, such as a cell phone, email account, pager, laptop, tablet computer, etc., to the remote server, or to some other location. In addition, messages could be sent to drying devices to change their parameters, shut off, etc. Further, data messages could be sent to the server, instructing that appropriate signals be sent to third parties and/or that final reports be generated, etc.

Fan and Heater

Referring now to FIGS. 14-21, an air mover device 16 according to one embodiment of the present invention is shown. The air mover 16 is provided with a primary inlet 186 and primary outlet 190. As will be further described, the air mover 16 includes an impeller disposed within a housing 194. The impeller operates to draw air through the primary inlet 186 and force it out through the primary outlet 190. Various impellers suitable for air moving operations are known. For example, U.S. Pat. No. 4,130,381 to Levin et al., which is incorporated by reference herein, discloses an impeller for an axial-flow fan. Those of skill working in the art will recognize that the size and dimensions of the impeller and impeller blades may vary based upon desired air flow rates to be generated.

Primary inlet 186 is equipped with a grate or similar device that prevents unwanted entrance of debris into the device without substantially restricting the flow rate through the inlet 186. In one embodiment, the primary outlet 190 and corresponding exhaust flow of air is generally perpendicular to the primary inlet 186 and corresponding intake flow. Thus, in one embodiment, drying, ventilation, and other air moving operations may be accomplished by drawing air from one region and exhausting it at various speeds and flow rates in order to dry, clean, or clear another location(e.g. a floor). Current devices known in the art, such U.S. Pat. No. 5,403,152 to Trautloff et al., which is incorporated by reference in its entirety herein, generally draw air in a direction parallel to a surface to be dried. The contemplated air mover 16 draws air primarily from a region located above the surface to be dried which typically will have a decreased saturation level, which improves drying efficiency.

In one embodiment, primary outlet 190 may be equipped with a grate and/or nozzles to direct air flow and reduce risk of injury that may result from the undesired entrance of objects into primary outlet 190. Primary inlet 186 and primary outlet 190 may further comprise devices to heat intake and/or exhaust flow of air as described in, for example, U.S. Pat. No. 6,52,3194 to Turner, IV, which is incorporated by reference in its entirety.

In addition to providing heating elements within an intake or exhaust portion of air mover 16, heating elements may also be provided external to the air mover 16 in order to aid in the drying processes. For example, various devices that implement heating may operate in conjunction with an air mover 16. Devices suitable for use in these applications include, but are not limited to, propane forced air heaters and electrical heater mechanisms for heating ambient air. These devices may be incorporated within or external to the air mover 16. For example, U.S. Pat. No. 6,615,508 to Valle, which is hereby incorporated by reference in its entirety, discloses a floor drying system with a heater mechanism disposed between an air intake and outlet for heating ambient air.

Alternatively, a heating mechanism may be located external to an air mover 16. For example, an electric coil heating mechanism or propane forced air heater may be located within or proximal to ducting at a distance away from the air mover 16. It will be recognized by those of skill in the art that one advantage to attaching ducting to the present invention is the ability to channel air from or to a variety of different locations. Accordingly, it will be further recognized that air may be channeled from an area including a heater or a heater may be disposed within ducting at a location between the source air or exhaust air, etc.

Embodiments of the present invention may further include systems to dispel or atomize substances in order to disinfect, freshen, or otherwise modify air. For example, an atomizer may be incorporated within an air flow path of an air mover, either within or proximal to the air mover. Such devices offer a user the ability to selectively disperse various chemical, cleaners, and/or fragrances to an area via the air flow produced by the air mover 16. Various commercial devices are currently known that provide the ability to selectively release such substances, either continuously or on specific or random time intervals. Materials to be used with such spraying mechanisms include, but are not limited to desiccants, disinfectants, air fresheners, moldicides, mildewcides and similar substances known to those working in the art.

Figure 14:
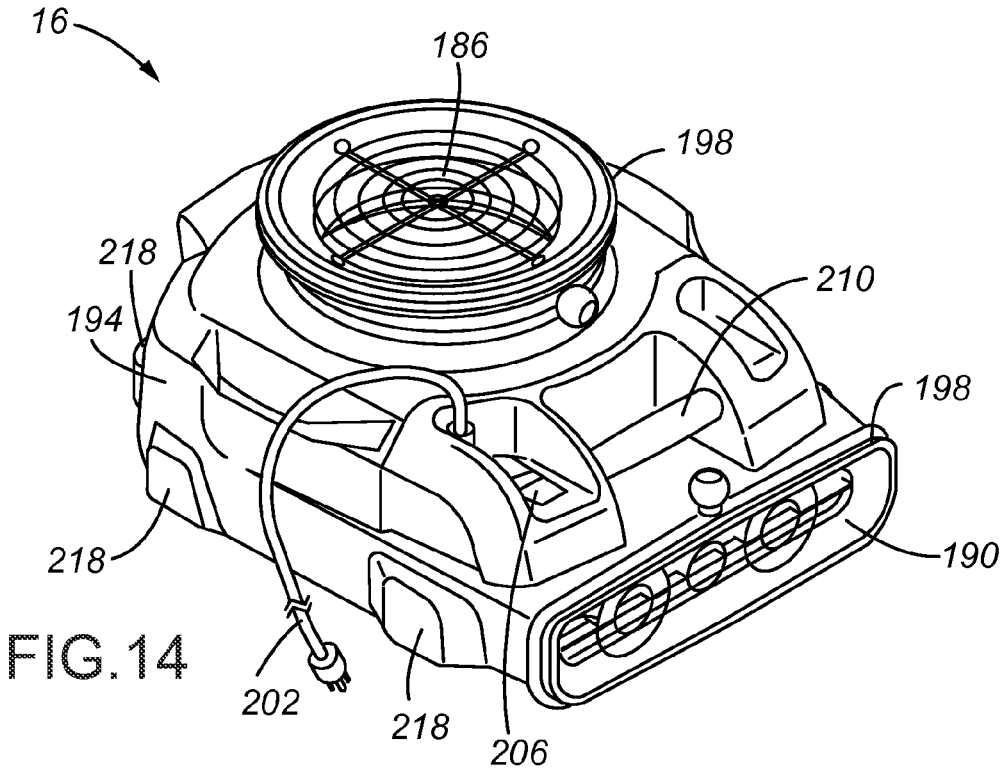
FIG. 14 is a perspective view of an air mover of one embodiment of the present invention.
Figure 15:
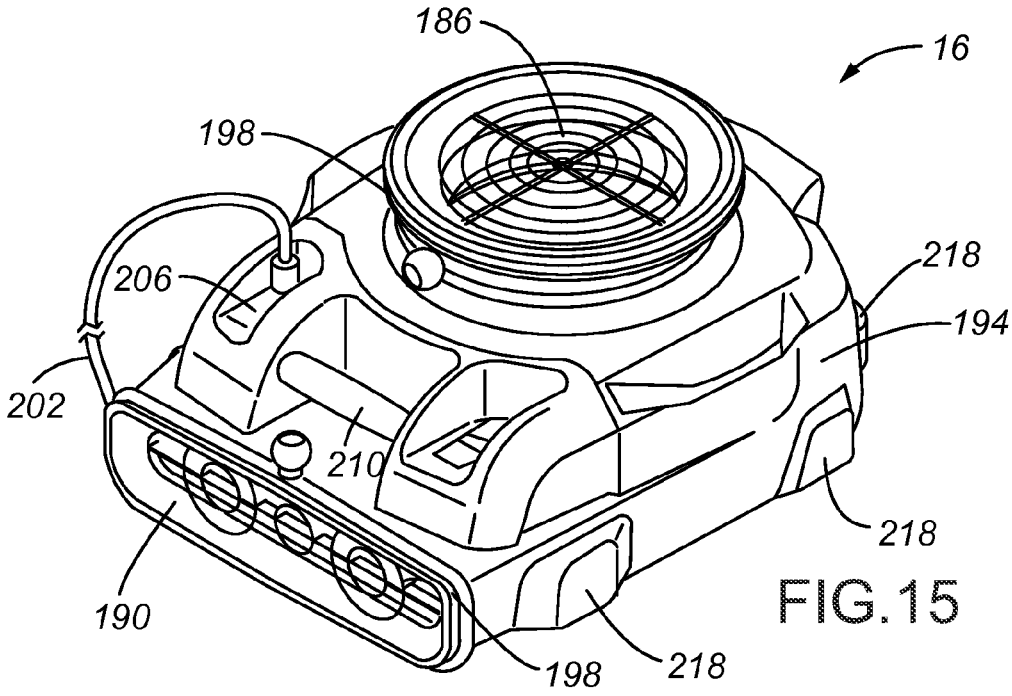
FIG. 15 is another perspective of the air mover of FIG. 14.
Figure 16:
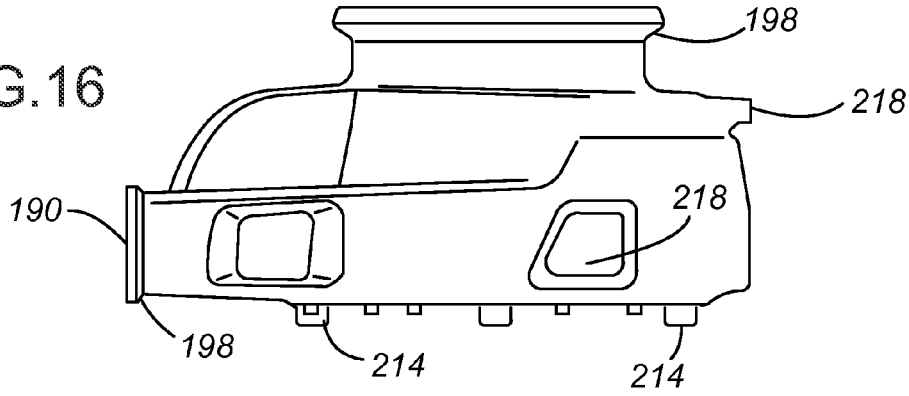
FIG. 16 is a side elevation view of the air mover of FIG. 14.

As shown in FIGS. 14 and 15, one embodiment of the disclosed device further comprises a lip or flange portion 198 positioned around a circumference of the primary inlet 186 and primary outlet 190. Flange members 198 allow for quick and secure attachment of power cords 202, extension cords, and like devices. For example, when the device 16 is not in use, a primary power supply cord 202 or extension cords may be wrapped around one or both of these flange portions 198. The ability to secure various items directly to the device 16 facilitates transportation and storage of the device 16.

Similarly, flange members 198 allow for the easy attachment of additional devices to the air mover 16, such as ducting. It will be recognized that the use of ducting in connection with aspects of the present invention may be desirable where, for example, air, gas, or fluid is to be conveyed to or from a remote location by the air mover 16. Various ducting, such as aluminum flex tubing, convoluted tubing, rubber hose, corrugated aluminum tubing, PVC tubing, polyester reinforced tubing, corrugated steel wall tubing, fiberglass tubing, spiral ducting tubing, and other similar ducting products known in the art may be used in combination with the present invention. In one embodiment, inlet portion 186 is constructed to receive spiral ducting, while a primary outlet 190 is constructed to receive lay flat ducting.

Embodiments of the present invention may further comprise power supply cords 202 and/or device for accommodating detachable power supply cords and extension cords that may further operate as power supply sources for additional devices. For example, a primary alternating current power supply may be provided to the device 16 through a power supply cord 202. The power supplied by this cord 202 may be used to run the device 16 as well provide additional power for other devices which may be connected by a power supply device 206. Power supply device 206 may be comprised of a GFCI socket or other similar device known in the art to divert or share current.

The outer structure of the air mover 16 may further comprise a handle 210 or similar means for carrying and relocating the device 16. It will be recognized that in certain cleaning and drying operations, frequent relocation of the device 16 may be necessary or desirable. Accordingly, a permanent handle 210 or other means for moving the device 16 is provided in one embodiment. Current devices are known to provide handles in the center of relatively wide air mover.

Accordingly, these devices require a large amount of effort and/or discomfort for a user to carry or transport due to the relative distance of the handle from a user's center of mass. Placing the handle 210 of the preferred device toward the front addresses this shortcoming of the prior art.

In one embodiment, the present inventive air mover 16 comprises base feet 214 (seen in FIG. 16) that elevate, support, and stabilize at least a portion of the device 16 from an area or surface to be dried or cleaned. Various features of the present invention, as will be described herein, are enabled by the elevation provided by the base feet 214 when the device 16 is utilized in horizontal operation. As will be recognized, that the force of exhausted air in combination with wet or damp surfaces upon which the present invention is typically used may result in the undesired movement or translation of the device 16. Accordingly, providing base feet 214 at least partially comprised of a rubber or similar non-skid material may be desirable.

Furthermore, the structure of air mover 16 comprises support feet 218 that enable the air mover 16 to be positioned and operate in various different arrangements. More specifically, support feet 218 allow for the device 16 to be positioned in a side position (i.e., where the width of the primary outlet 190 is positioned generally perpendicular to a planar floor surface) or in a vertical position (i.e., where the primary outlet 190 is generally directed upward).

Support feet 218 further provide for the ability to stack, orient, or align multiple air movers 16 in combination with each other. For example, when it is desirable to arrange two or more air movers 16 in a side position, corresponding support feet 214 may allow for the devices to be stacked. In one embodiment, at least some of the support feet 218 comprise a generally flat planar surface upon which the device 16 may rest or where additional devices of the same or similar construction may rest. Accordingly, support feet 218 allow for the device 16 to be arranged in various different positions or in combination with additional devices.

Figure 17:
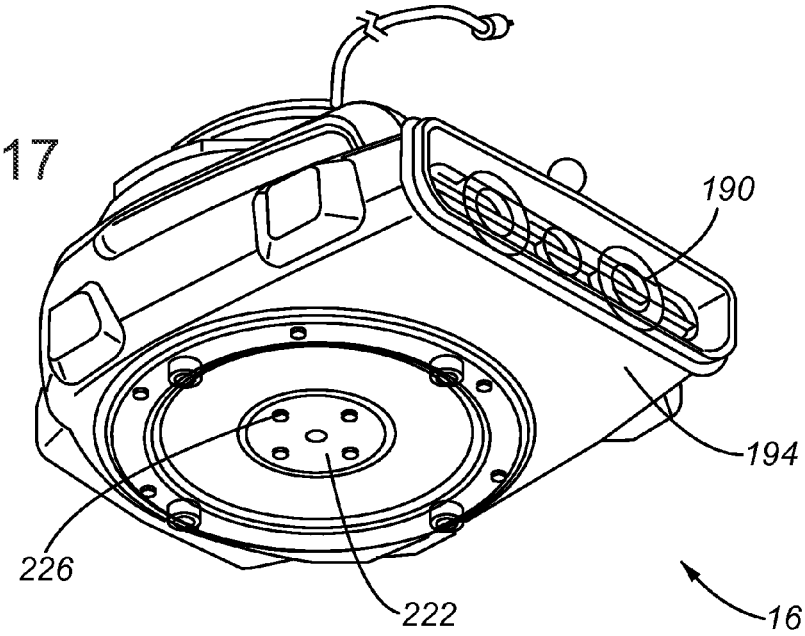
FIG. 17 is a bottom perspective view of the air mover of FIG. 14.

Referring now to FIG. 17, a bottom view of the air mover 16 is provided. In one embodiment, a louver 222 is provided in a bottom portion of the air mover 16 that is comprised of a circular plate with apertures 226 formed therethrough. In one embodiment, the louver 222 is rotatably mounted upon a portion of the device housing 194, yet is in sufficiently close proximity and/or communication with device housing 194 to prevent or limit air flow through or around the louver 222 when it is in a closed position. The rotatably mounted louver 222 allows for the ability to selectively rotate the louver to align with corresponding holes or ports in the housing 194 when air flow through the louver 222 is desired. Similarly, the louver 222 may be rotated so that it is misaligned with ports in the housing 194 when air flow through the louver 222 is not desired.

Louver 222 may be optionally closed or opened to a variety of positions to enable air flow through a bottom portion of the air mover 16, as well as through the primary outlet 190. For example, when high pressure operation is desired, louver 222 may be closed to render the primary outlet 190 the exclusive exhaust port for air. When lower pressure operation is desired, or where it is desirable to vent air to a region located beneath the air mover 16, louver 222 may be opened, either partially or fully, to vent air from the primary intake 186 through the louver 222 and the primary outlet 190.

Although in one embodiment the louver 222 primarily operates as an optional exhaust port, it will be recognized that louver 222 may similarly operate as an air intake. For example, where air drawn in through a primary intake 186 travels toward the primary outlet 190 at high velocities and creates a lowered pressure within the device 16, air may also be drawn in through the louver 222. Furthermore, although FIG. 17 depicts a louver 222 as containing generally circular apertures 226, it will be recognized that louvers 222 of the present invention are not limited to any specific form, shape, size, etc. For example, louver 222 may be comprised of parallel slots of various shapes and orientations that are selectively adjustable to control or limit the amount of air allowed to pass through the louver 222. It will also be recognized that objects of the present invention may be accomplished without a discrete number of louvers 222 or apertures beneath the air mover 16. For example, the device 16 may include a portion of a bottom surface which is fully removable, thus creating a single aperture in the bottom surface through which air and gases may be conveyed.

Referring now to FIGS. 18-20, the impeller assembly 230 for use in various embodiments of the present inventive air mover 16 is shown. In one embodiment, at least one primary impeller 234 is employed to move air and gas through various components of the present invention. Impeller 234 is driven by co-axially mounted motor 238 and further supported by a motor stand 242. It will be recognized that various motors, including, but not limited to, alternating current induction, alternating current synchronous, direct current stepper, direct current brushless, and direct current brushed motors may serve objects of the present invention. However, it will further be recognized that various embodiments of the present invention may be used in industrial cleaning and floor drying situations and thus require sufficient power to move the desired volume of air at a desired velocity. For example, one embodiment of the present invention contemplates an exhaust flow rate of approximately 20 cubic feet per minute at an air velocity of 24 miles per hour achieved through the use of 1.48 amps of current.

The motor mount 242 comprises fastening member 246 capable of securely connecting the motor assembly and impeller 234 to a portion of the air mover 16 housing 194. In addition to providing for stability of the motor 238 and impeller 234 during operation, fastening member 246 further offer the ability to remove the motor assembly 238 and impeller assemblies 230 without excessive deconstruction of the air mover 16. For example, a motor mount 242 may be directly connected to a base portion of the device housing 194 via fasteners 246. Accordingly, the motor mount 242, motor 238, and impeller 234 may be removed as a single assembly by removing the fasteners 246 and withdrawing the assembly through the resulting aperture in the base portion. In this manner, various internal components of the present invention may be quickly and easily removed from the device for cleaning, repair, and/or replacement.

Figure 21:
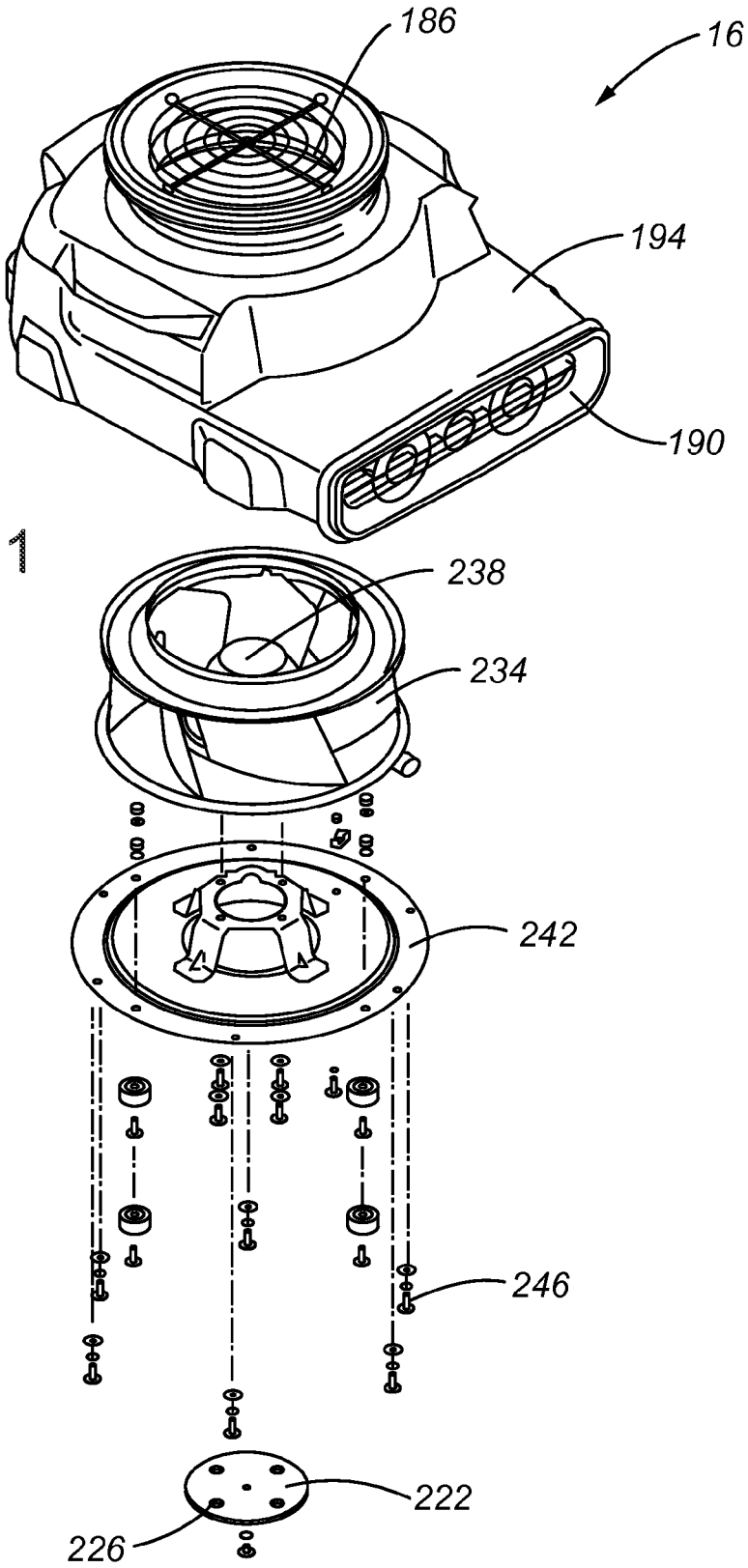
FIG. 21 is an exploded view of the air mover and its related impeller assembly of one embodiment of the present invention.

FIG. 21 is an exploded perspective view showing assembly of the air mover 16 according to various embodiments as described herein. The impeller 234, motor 238, and motor mount 242 assemblies may be inserted into a bottom portion so that a center axis of the motor 238 and impeller 234 are aligned with a center axis of the primary inlet 186 and positioned generally perpendicular to center axis of a primary outlet 190 of the air mover 16. Impeller 234 and motor stand 242 may be secured to a portion of the device housing 194 via fasteners 246. A louver 222 may be secured to a base portion of the motor mount 242 to optionally allow for additional venting of air or gas through a bottom portion of the device 16. As one of skill working in the art will recognize, the assembly of various components of the present invention may facilitate the selective removal of one or more components. As previously described, the entire impeller 234, motor mount 242, and louver 222 may be removed as a unit. Alternatively, a portion or portions of this unit may be selectively removed due to its stacked construction.

Quick Connect Systems

Figure 22:
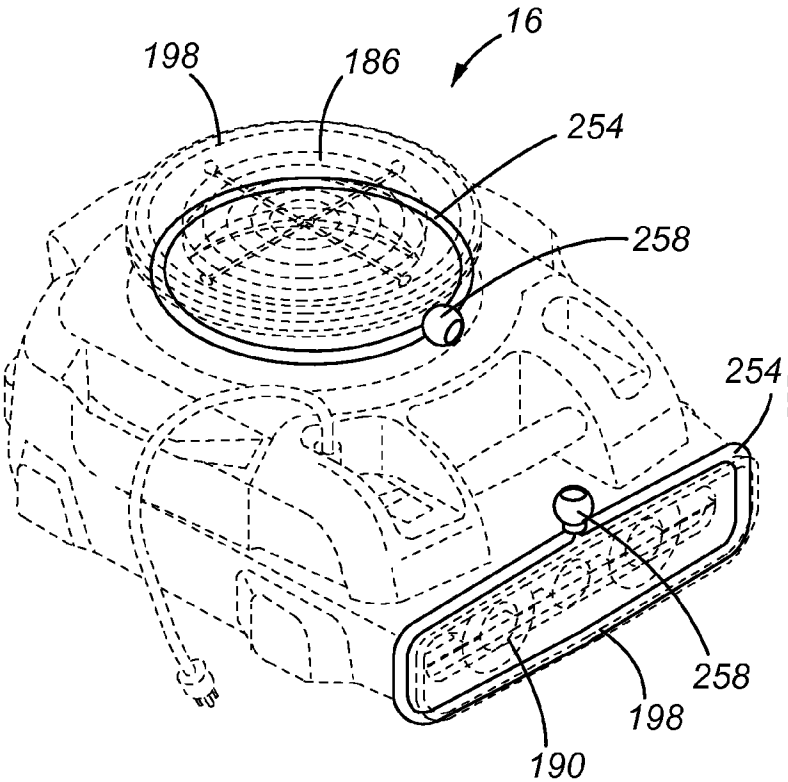
FIG. 22 shows portions of a quick connect system for securing ducting to various devices of the present invention.

Referring now to FIGS. 22-26, various other features of one embodiment of the present inventions are shown. Specifically, various devices and methods for securing objects to an air mover 16 are depicted. FIG. 22 depicts an elastic member 254 that may be comprised of devices commonly referred to as bungee or shock cords, which typically consist of one or more strands of an elastic material and which may be covered by a sheath or housing comprised of nylon, cotton, or similar materials. In one embodiment, the elastic member 254 is formed as a closed loop, with its ends securely fastened together and surrounded by a projection 258 which is conducive to user operation. For example, projection 258 may be comprised of a sphere which provides an interface for a user to grip in order to remove, apply, or otherwise easily interact with the elastic member 254.

The elastic member 254 may be secured around a lip or flange portion 198 of a primary inlet 186 and/or a primary outlet 190. In one embodiment, the elastic member(s) 254 may be used to secure ducting or similar devices to at least one portion of device 16. For example, ducting may be provided as a conduit to transport clean air from a surrounding environment to an air mover 16, where it is subsequently exhausted by the air mover 16 to dry surfaces and/or ventilate an area. Those of skill in the art will recognize that ducting may be connected to any, all, or none of the inlet and exhaust portions of drying equipment in order to facilitate remediation of the building.

Figure 23:
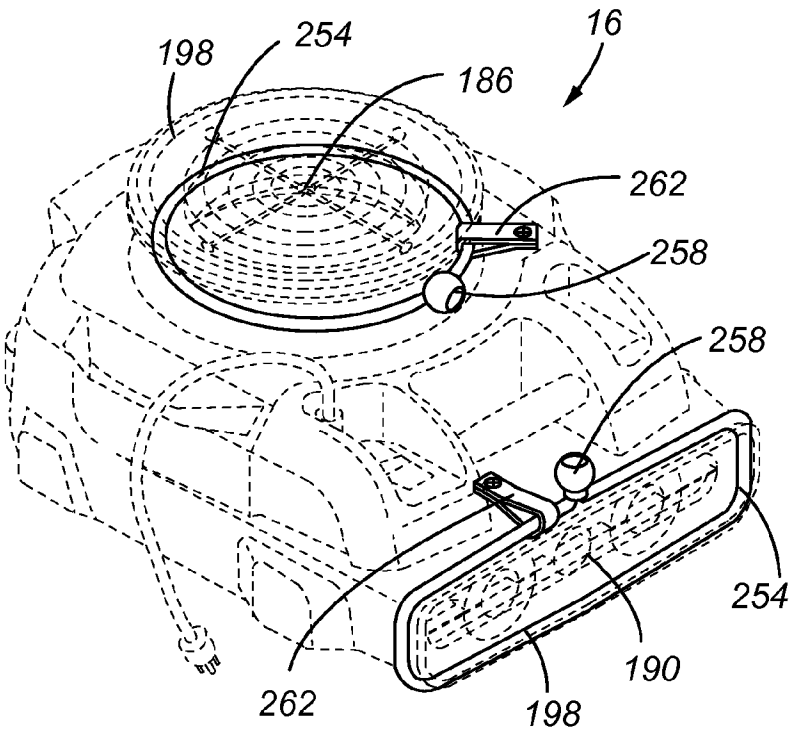
FIG. 23 shows portions of the quick connect system of the present invention.

FIG. 23 further illustrates an elastic member 254 with a projection 258 and a lanyard or attachment member 262, which may be incorporated with elastic member 254 of one embodiment. The lanyard or attachment means 262 may be comprised of a variety of materials, including, but not limited to, nylon, cotton, plastic, metals, or other materials of sufficient durability. In one embodiment, the lanyard 262 functions to secure the elastic member 254 to a specific device to prevent or reduce the risk of loss or misplacement of the elastic member 254. Accordingly, lanyard 262 may be attached to the elastic member 254 (e.g. formed as a portion of the elastic member or stitched fixedly to the elastic member), attached to the corresponding air mover 16, or provided as a separate component. In one embodiment, lanyard 262 may be attached to an air mover 16 or other drying device by a screw or similar fastening means to prevent misplacement of elastic member 254 when the elastic member 254 is not in use to secure ducting directly to the device. Various methods for securely connecting a lanyard 262 to a device will be recognized by those of skill in the art. Alternatively, a lanyard 262 may be threaded through, looped around, or formed as a protrusion of a host device 16, or attached with a variety of other known fasteners, including, but not limited to, Velcro, magnets, glue, etc.

Figure 24:
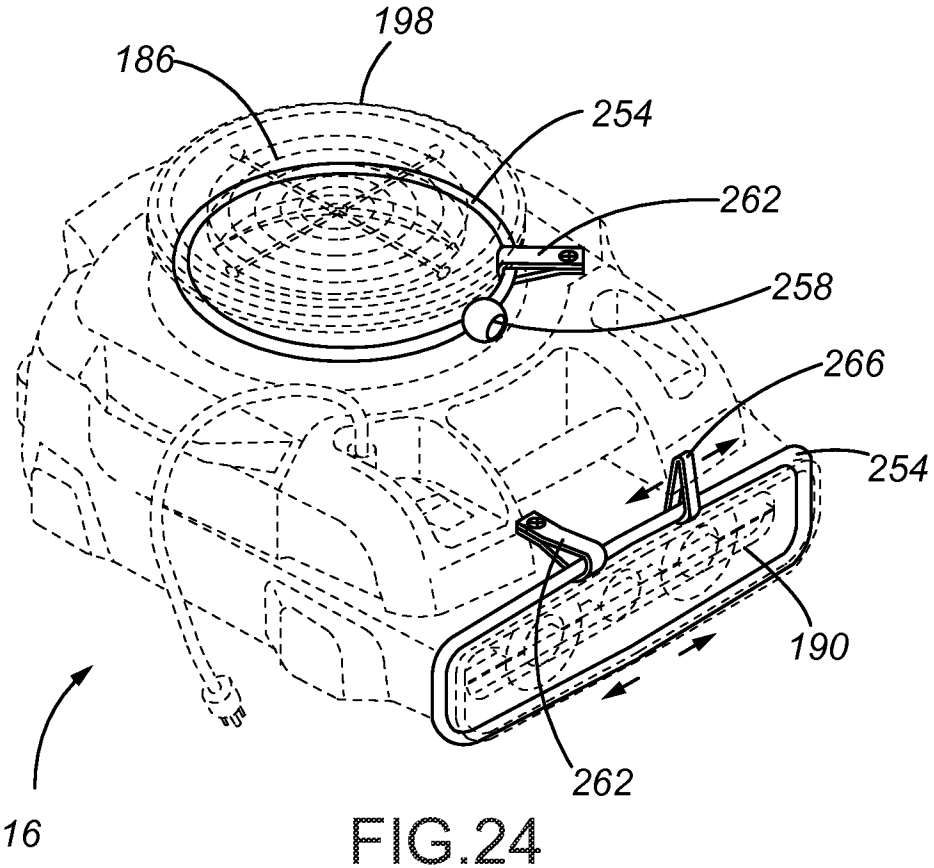
FIG. 24 shows various quick connect systems of the present invention.

FIG. 24 depicts another embodiment of the present invention wherein an elastic member 254, a lanyard 262, and a pull tab 266 are contemplated. In one embodiment, pull tab 266 may comprise a device for quick removal and application of elastic member 254 to various corresponding devices. As those of skill working in the art will recognize, removal of the elastic member 254 may be burdensome, particularly when the elastic member 254 is secured around the circumference of another object and/or where the elastic member 254 is placed in a significant amount of tension. In one embodiment, pull tab 266 may be selectively attached to the elastic member 254 and capable of being slid or translated around a circumference of the elastic member 254, thus gradually prying the elastic member 254 from its corresponding component 16. The device 266 and method may be particularly useful, for example, where the elastic member 254 is secured around a lip or flange 198 of an air mover 16 or similar structure of other drying equipment. Elastic member 254 may be further equipped with a lanyard 262 or similar attachment means as previously described. In another embodiment, pull tab 266 may be attached to the elastic member 254. Accordingly, pull tab 266 may operate as a means for gripping at least a portion of the elastic member 254 to facilitate application and removal. It will be recognized that pull tab 266 of such an embodiment is not limited to any particular shape or dimensions.

Figure 25:
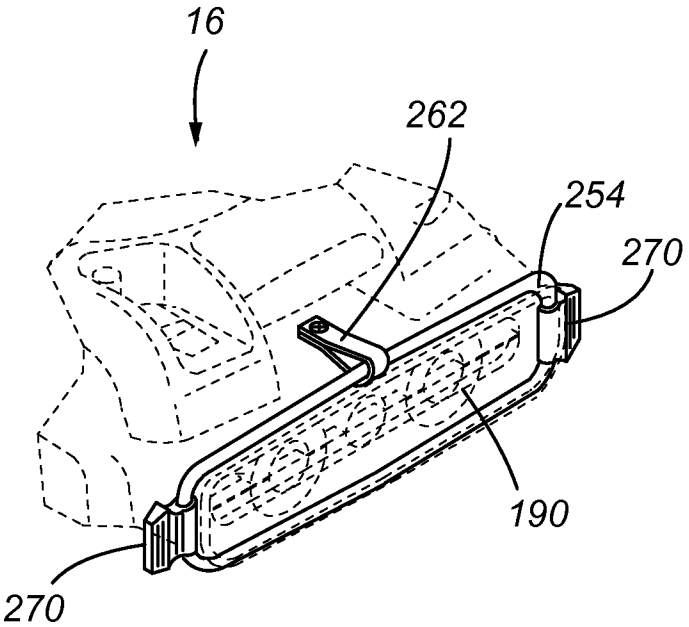
FIG. 25 shows various quick connect systems of the present invention.

FIG. 25 depicts yet another embodiment where an elastic member 254 is equipped with a plurality of pull tabs 270. In one embodiment, pull tabs 270 are selectively attached to elastic member 254 and thereby allowed to slide around a circumference of the elastic member 254 to assist in the removal or prying of the elastic member 254 from an attached device 16. Alternatively, one or more of the pull tabs 270 may be attached to the elastic member 254. For example, one pull tab 270 may be affixed to the elastic member 254 while another is free to slide around a circumference of the elastic member 254. The fixed pull tab 270 may be used to stabilize the device while the non-fixed tab may be used in conjunction to gradually free the elastic member 254 from a variety of other objects. In another embodiment, both pull tabs 270 may be fixedly attached to the elastic member 254. It will be recognized that the present invention is not limited to a specific number of pull tabs 270. For example, where an elastic member 254 will be applied to another device under a significant amount of tension, it may be desirable to include pull tabs 270 in excess of two. As shown in FIG. 25, an embodiment of the present invention with a plurality of pull tabs 270 may further include attachment means 262 to further secure the elastic member 254 to a device.

Figure 26:
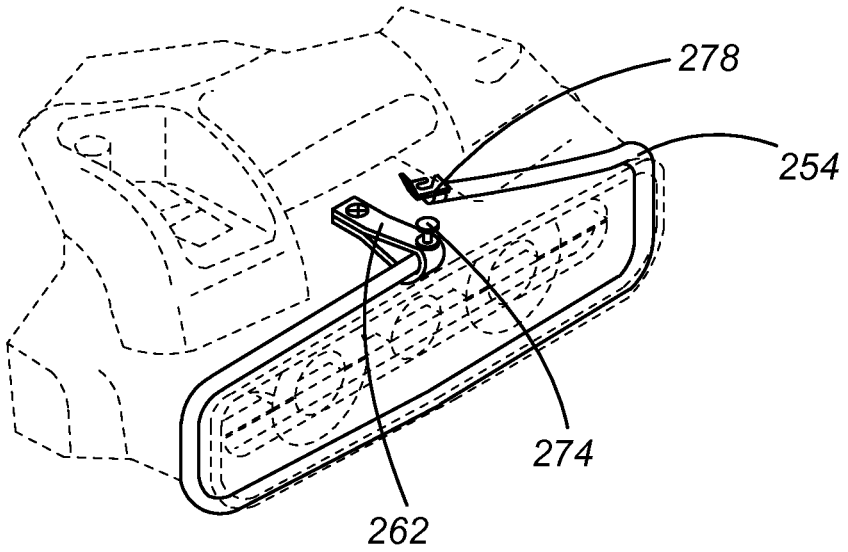
FIG. 26 shows various quick connect systems of the present invention.

FIG. 26 depicts yet another embodiment of the present invention wherein opposing ends of an elastic member 254 comprise connecting members 274, 278. As those of skill working in the art will recognize, connecting means 274, 278 provide for easy attachment and renewal of an elastic member 254 as connecting means 274, 278 may be readily connected or disconnected from one another. Connecting means 274, 278 of elastic member 254 may include, but are not limited to buckles, clasps, threaded members, opposing hooks, latches, hook-post combinations, magnets, and other similar devices. In one embodiment, connecting means 274, 278 comprise a post 274 and hook 278 that form a sufficient securing mechanism when an elastic member 254 is placed is in tension, but allow for relative ease in removal the elastic member 254.

One of skill working in the art will recognize that the present invention 20 is not limited to a specific length, width, or elasticity. It will be recognized that the size and restoring force of an elastic member will vary with respect to the desired application. Accordingly, numerous variations of size and elasticity are contemplated as within the scope of the present invention.

The Air Filter and Chemical Injector

Referring now to FIGS. 27-37, various filter devices 282 are shown which may be operated in connection with an air mover. Filter devices 282 are known to provide various benefits, including the removal of airborne allergens, contaminants, and other particles. For example, U.S. Pat. No. 6,976,911 to Lanham et al., which is incorporated by reference in its entirety herein, discloses a method and apparatus for filtering airborne contaminants.

One advantage of filter devices 282 of the present invention is that air filtration and purification may be accomplished by utilizing the power generation features of other devices, such as air movers, which may already be in operation. For example, the filter 282 may be mounted upon a lip or flange portion 198 of air mover 16 and sealed to prevent or minimize the amount of air that bypasses the filter stages or that escapes from the air mover 16. In this manner, the filter 282 may comprise a generally passive device that is free from the needs and complications posed by energy consuming filter devices. As will be understood by those of skill in the art, the filter may be attached to an air mover in any suitable fashion, specifically including manufacturing the two devices as one.

Figure 27:
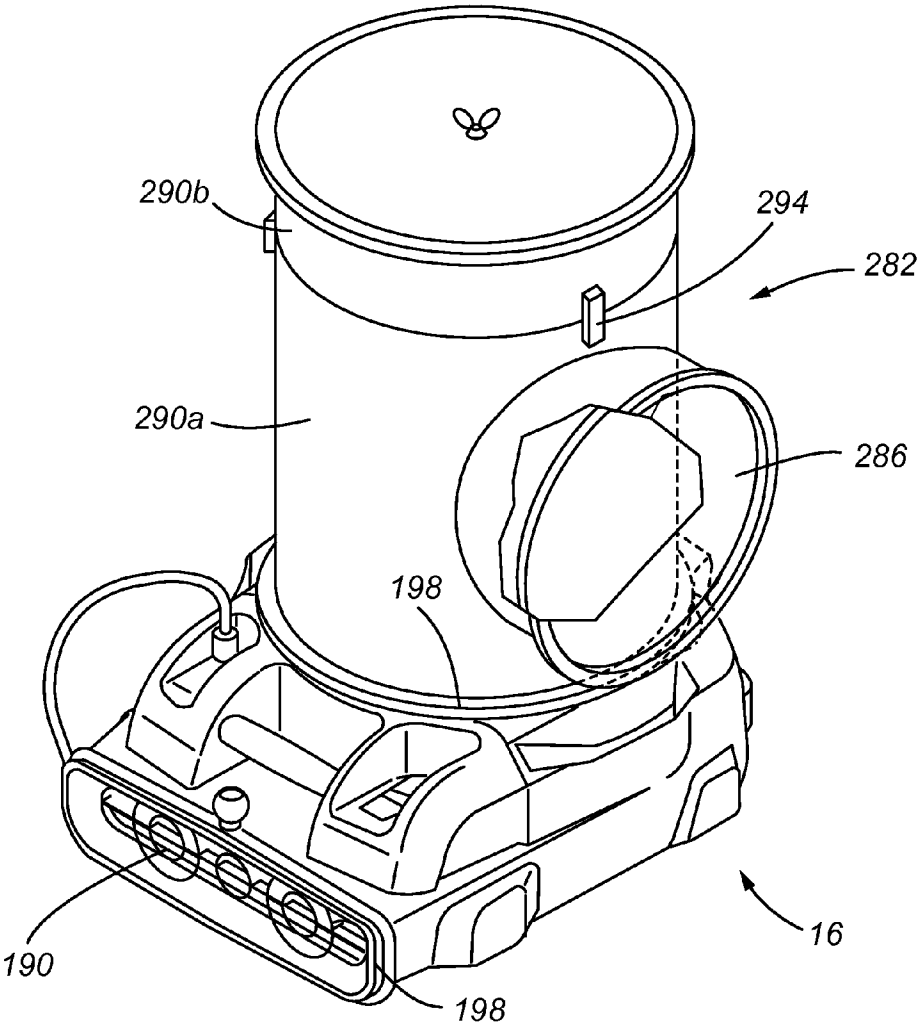
FIG. 27 shows a perspective view of a filter assembly of the present invention integrated into a preferred air mover.

FIG. 27 depicts one embodiment of filter device 282 and comprises one or more filter stages. For example, a first filter stage may be disposed within an inlet portion 286 of the filter housing 290. The first filter stage may be comprised of any one of a variety of filters currently known in the art, or combinations thereof. For example, the first filter stage may be comprised of a pleated electrostatic filter, high density carbon filter, reticulated foam filter, pleated paper filter, oiled cotton gauze filter, membrane filter, high efficiency particulate air filter ("HEPA") filter, or other similar devices. Various devices suitable for use in the present are known. For example, U.S. Pat. No. 6,428,616 to Tsai et al. discloses a high efficiency particulate air filter and method for making the same, and is incorporated by reference in its entirety herein. U.S. Patent Application Publication No. 190609/01903477 to Workman discloses a panel-type HVAC filter and is also hereby incorporated by reference in its entirety.

It will be recognized that an inlet portion of the filter device 282 need not be located or oriented in any specific manner. For example, a top portion of the filter housing 290 may comprise the primary inlet of the filter device 282, which may further include a lip or flange as previously described.

In one embodiment, filter housing 290 may comprise a quick-release or latch mechanism 294 to facilitate the removal and/or replacement of filter components contained within and to facilitate easy cleaning of the internal space of the housing. For example, a filter clamp that extends around a circumference of the filter unit 282 may be employed to attach and seal two portions of the filter housing 290*a* & *b* together in order to provide an air and water tight seal, yet still allow for removal of at least a portion of the housing 290*a* & *b* when filter components require cleaning and/or replacement. The clamp may further comprise additional sealing means, such as a gasket disposed within separable portions of the filter housing 290, to further provide an air and water-proof seal for the housing 290.

Figure 29:
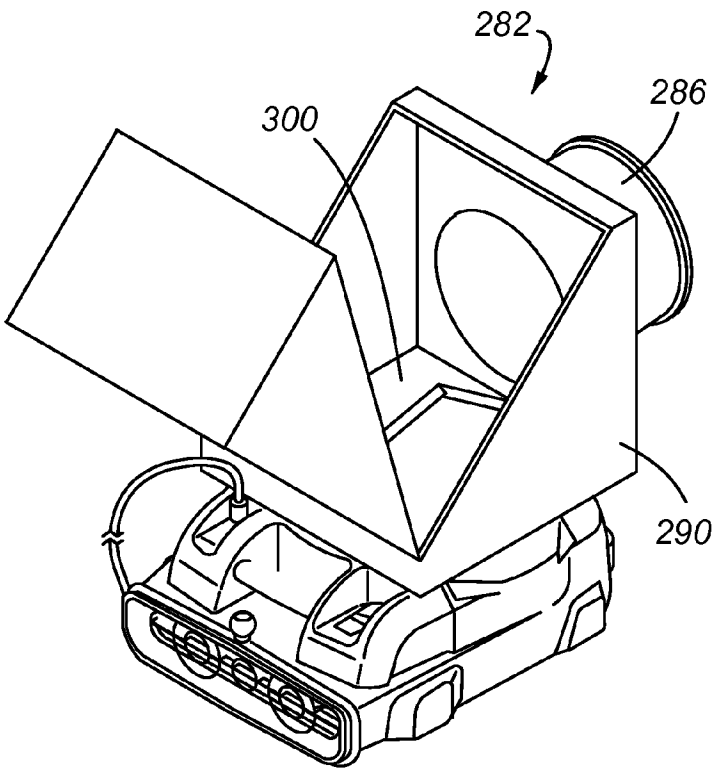
FIG. 29 shows a top perspective of a filter assembly of the present invention integrated into a preferred air mover.
Figure 28:
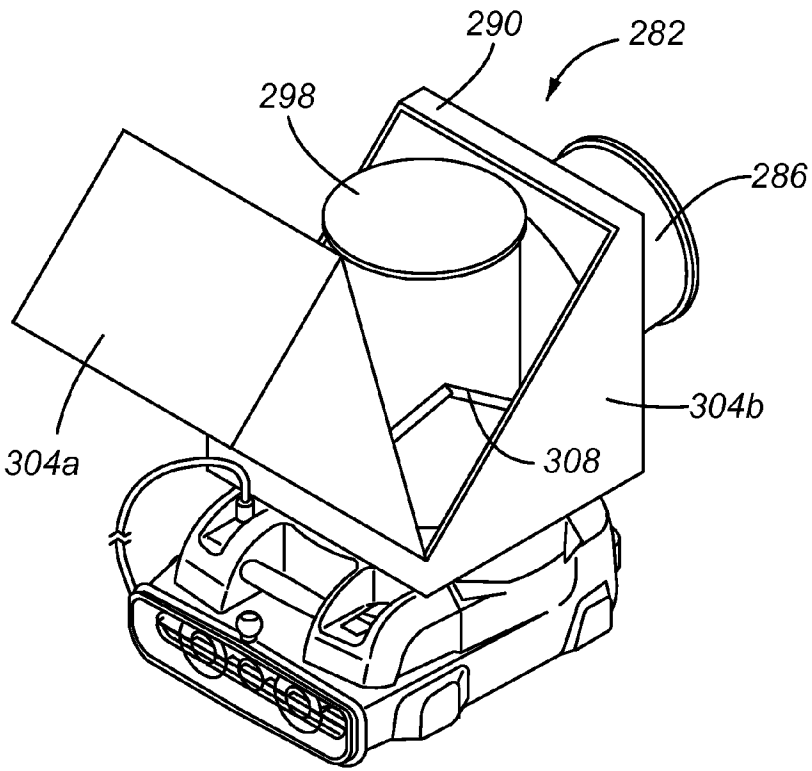
FIG. 28 shows a top perspective view of a filter assembly of the present invention integrated into a preferred air mover.

Referring now to FIGS. 28 and 29, the filter stages may be disposed within the filter housing 290, either in replacement of or in combination with the first filter stage. For example, a cylindrical filter 298 may be disposed within the filter housing 290. Cylindrical filter 298 may be comprised of any number of known filter devices as previously described. It will be recognized that a conical filter may be employed in place of the cylindrical filter 298. Conical filters known in the art, such as those frequently employed in the automotive industry, may be utilized in various embodiments of the present invention.

In another embodiment, a panel filter 300 may be disposed within the filter housing 290 in addition to or in lieu of a filter disposed within inlet portion 286 and/or a cylindrical filter 298 as previously described. Various filters known in the art, including those described herein, as well as various fiberglass and/or pleated filters may comprise the panel filter 300 of the present invention. It will be recognized that the scope and spirit of the present invention is not limited to any number or specific arrangement of the above referenced filter components. While it will be understood by those working in the art that additional filter elements may increase the level of filtration and purification at the expense of flow rate and pressure loss, any number of stages of filters may be employed within the filter housing as previously described.

In another embodiment, the filter housing 290 includes an inlet portion 286 with a lip or flange portion which facilities the attachment of additional devices, such as ducting. Ducting may be connected to the inlet portion 286 through the use of various devices including, but not limited to, elastic members 254 as previously described. Various ducting as described above, may also be used in combination with the present invention.

Accordingly, inlet portion 286 of filter 282 may either draw air from the filter housing's 290 immediate surroundings, or may draw air from another location or environment (e.g. another room or structure) through the connected ducting. Similarly, various forms of ducting as previously described may be attached to a flange portion 198 of a primary outlet 190 of an air mover which is attached to the filter housing 290.

FIG. 28 depicts another embodiment of the filtration device 282 wherein the filter housing 290 is comprised of a hinged enclosure to allow for ease of access to an interior portion of the device 282 and filtration components housed therein. Filter housing 290 may be comprised of two portions 304*a* and *b*, which may be hinged to allow for ease of opening the device. In addition to being hingedly connected, housing portions 304*a* and *b* may further be connected with a hinged arm 308 to further facilitate opening and to prevent complete separation of the housing portions 294. Additionally, filter housing 290 may comprise an inlet 286 as previously described, or variations thereof.

In one embodiment, filter device 282 comprises a cylindrical filtration unit 298 disposed within the housing 290. Filter unit 298 may be comprised of a pleated electrostatic filter, high density carbon filter, reticulated foam filter, pleated paper filter, oiled cotton gauze filter, membrane filter, high efficiency particulate air filter ("HEPA") filter, or other similar devices known in the art. Furthermore, filter unit 298 may comprise the only filtration unit of the device 282, or may act in series or parallel with various other filter units as previously described.

It will be recognized that the present invention should form a substantially sealed unit when the housing portions 304*a* and *b* are in a closed position. Accordingly, various devices known in the art may be utilized to accomplish a satisfactory seal of the filter housing 290. For example, a gasket or ring may be provided around or peripheral to the interface between housing portions 304*a* and *b*. Furthermore, a clamp or latch mechanism may further be provided to obtain the desired seal.

FIG. 29 depicts yet another embodiment of the present invention wherein a filter comprised of a hinged enclosure unit includes a panel filter 300 disposed within. As previously described, panel filter 300 may operate as the sole filter stage or may be used in conjunction with one or more additional filter elements.

Figure 30:
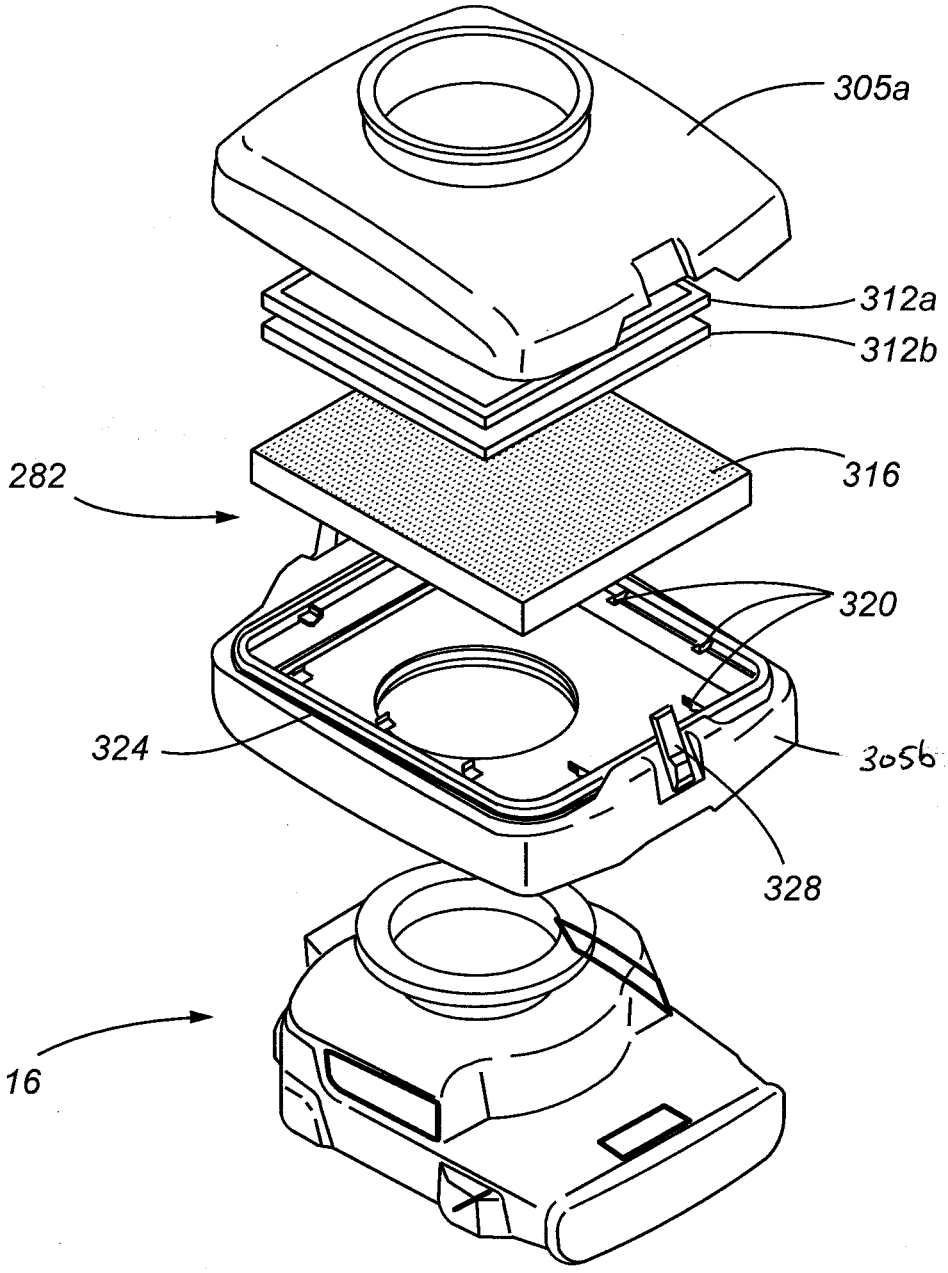
FIG. 30 is an exploded view of a second type of filter assembly of the present invention.
Figure 31:
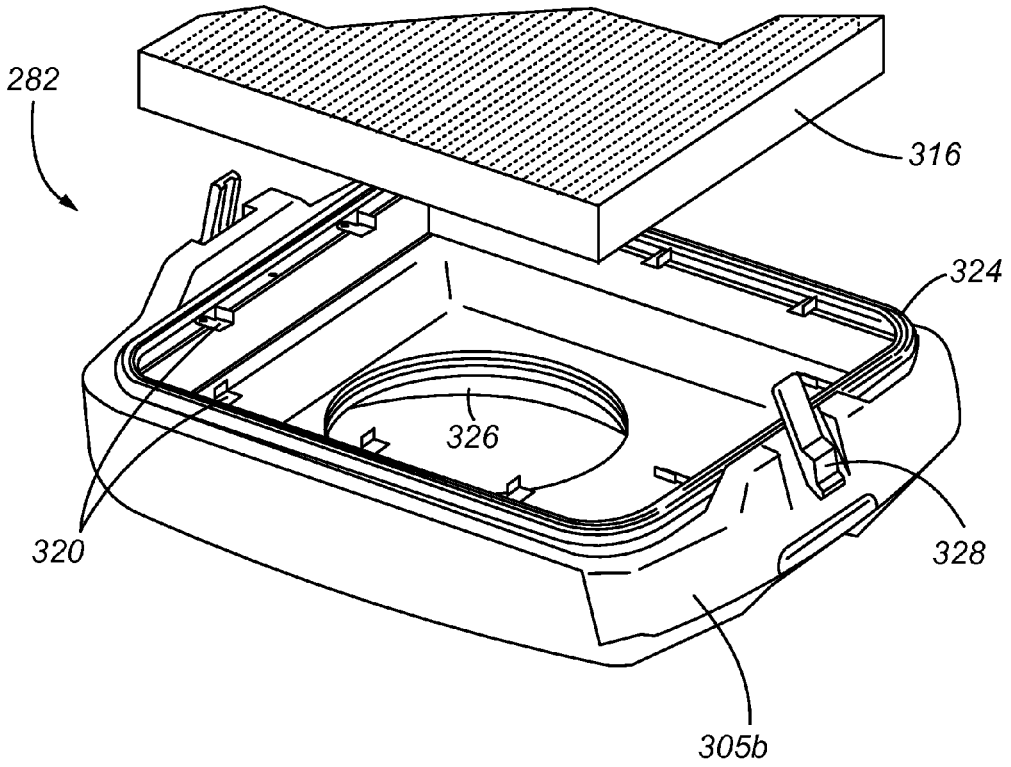
FIG. 31 is a partial perspective view of a filter assembly of the present invention.
Figure 32:
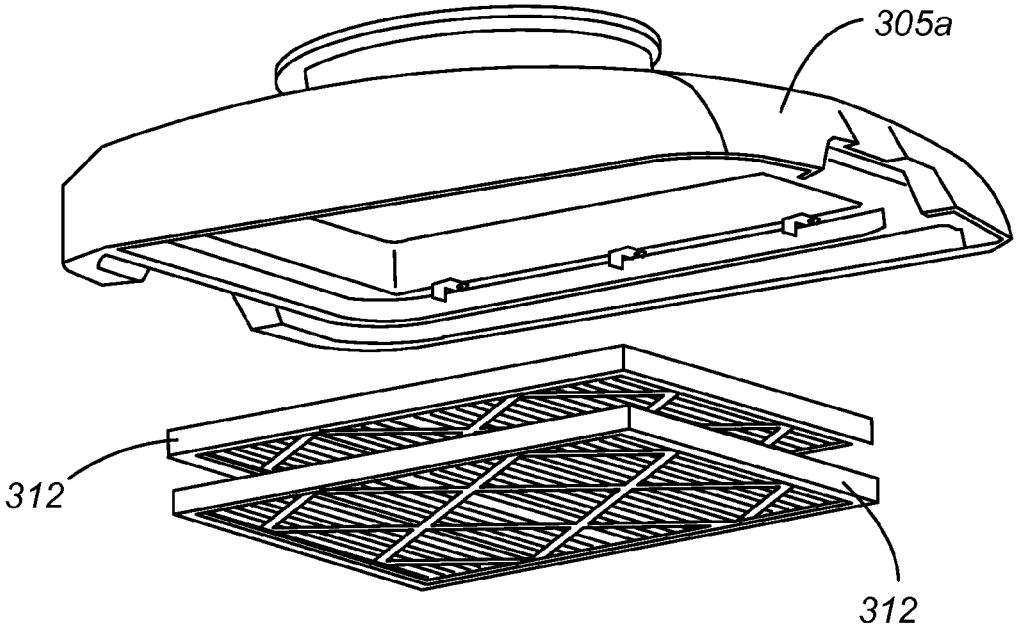
FIG. 32 is a bottom perspective partial exploded view of a filter assembly of the present invention.

Referring now to FIGS. 30-37, a filtration device for use in connection with an air mover 16, according to one embodiment of the present disclosure is shown. FIG. 30 is an exploded perspective view of a filtration device 282 according to one embodiment of the filter device. Filtration device 282 consists of housing portions 305*a* and *b* which may contain various filter stages 312, 316. In one embodiment, one filter stage consists of a HEPA filter 316 which may be attached to a portion of the housing 304*a* and *b*. Fastening member, such as retaining clips 320 may be employed to secure a HEPA filter 316, or similar device, in a desired location. One of skill working in the art will recognize that retaining clips 320 may be comprised of any number of known devices, including, but not limited to biased members capable of receiving a filter panel 316. In one embodiment, additional panel filters 312*a* and *b* such as those previously described may be contained within the filtration device 282. One or more of these filter stages 312*a* and *b* may be disposed within the filter housing and may constitute a replacement to the previously described HEPA filter 316 or may act to filter air or fluid in addition to HEPA filter 316.

In one embodiment, a filtration device 282 comprises a sealing element 324 which is useful for obtaining an airtight seal between housing portions 305*a* and *b*. One of skill working in the art will recognize that it may be desirable to provide housing portions 305*a* and *b* which are separable and allow for the removal and/or replacement of filter elements 312, 316. It will further be recognized, however, that when filter housing portions 305*a* and *b* are placed in contact with each other, it is desirable to prevent or minimize the unwanted escape or entrance of air from an interface between housing portions 305*a* and *b*. Accordingly, a sealing element 324 (for example, a rubber gasket) may be provided to reduce the risk of unwanted air flow.

Clasps 328 may also be provided to facilitate the appropriate seal between filter housing portions 305*a* and *b*. A variety of latches or clasps known in the art may be implemented to secure housing portions 305*a* and *b* in close communication with each other and to apply an appropriate amount of compression on a sealing element 324. It will be recognized that various fastening devices 328 may be used to accomplish objectives of the present inventive air filter. For example, housing portions 305*a* and *b* may be secured together with nuts and bolts, c-clamps, a clamp(s) that surrounds a circumference of the unit 282, and/or various other devices known in the art.

Figure 33:
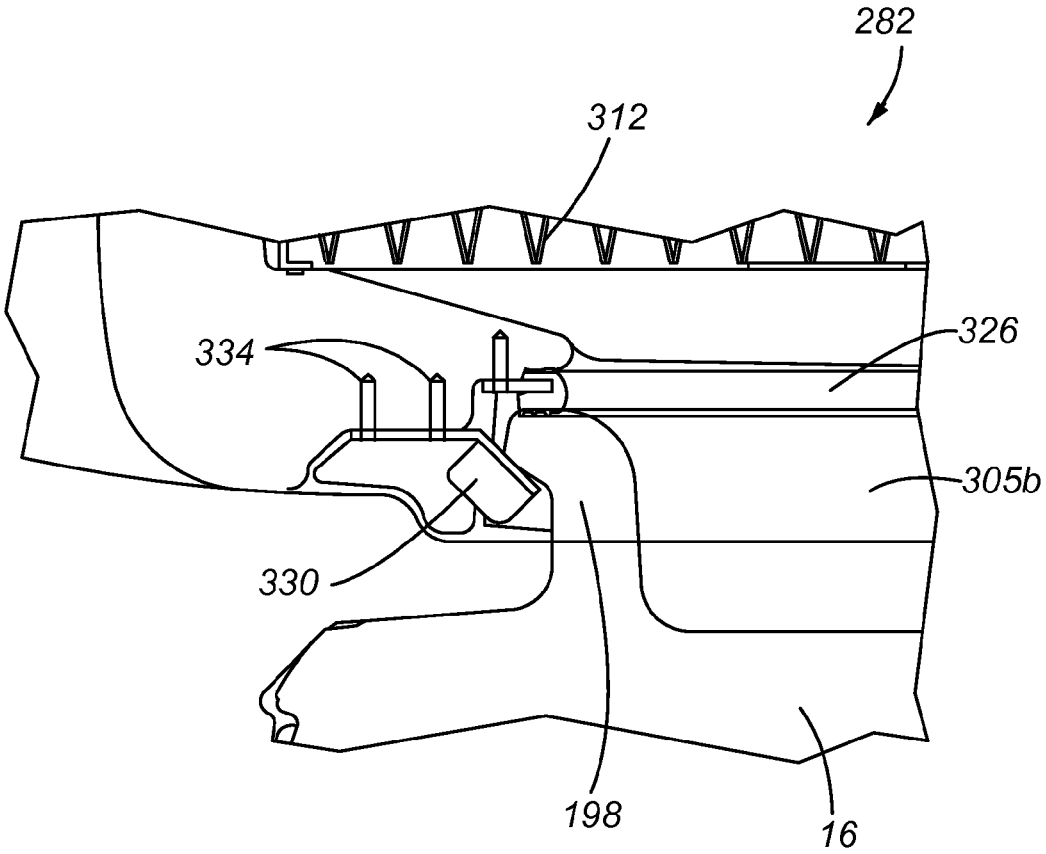
FIG. 33 is a view of a connection mechanism utilized to connect a filter assembly to the air mover of the present invention.
Figure 34:
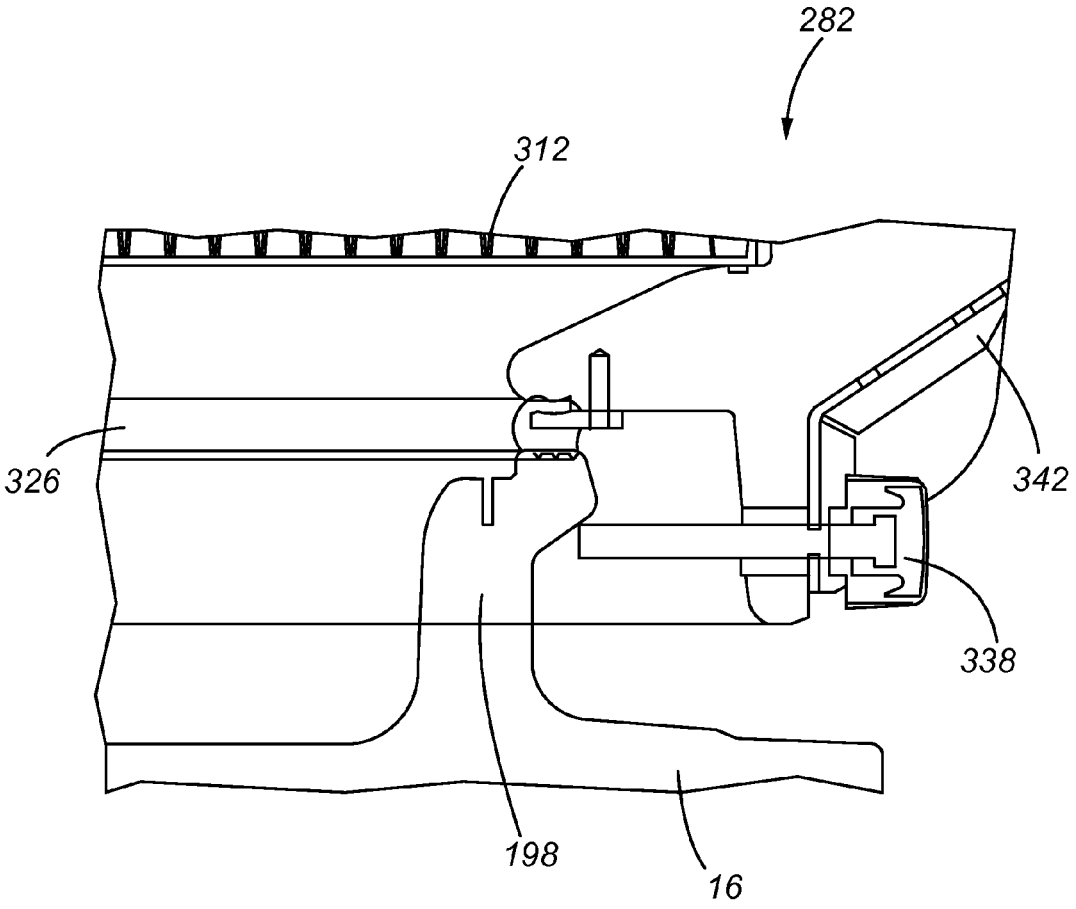
FIG. 34 is a view of a second connection mechanism utilized to connect the filter assembly to the air mover of the present invention.
Figure 35:
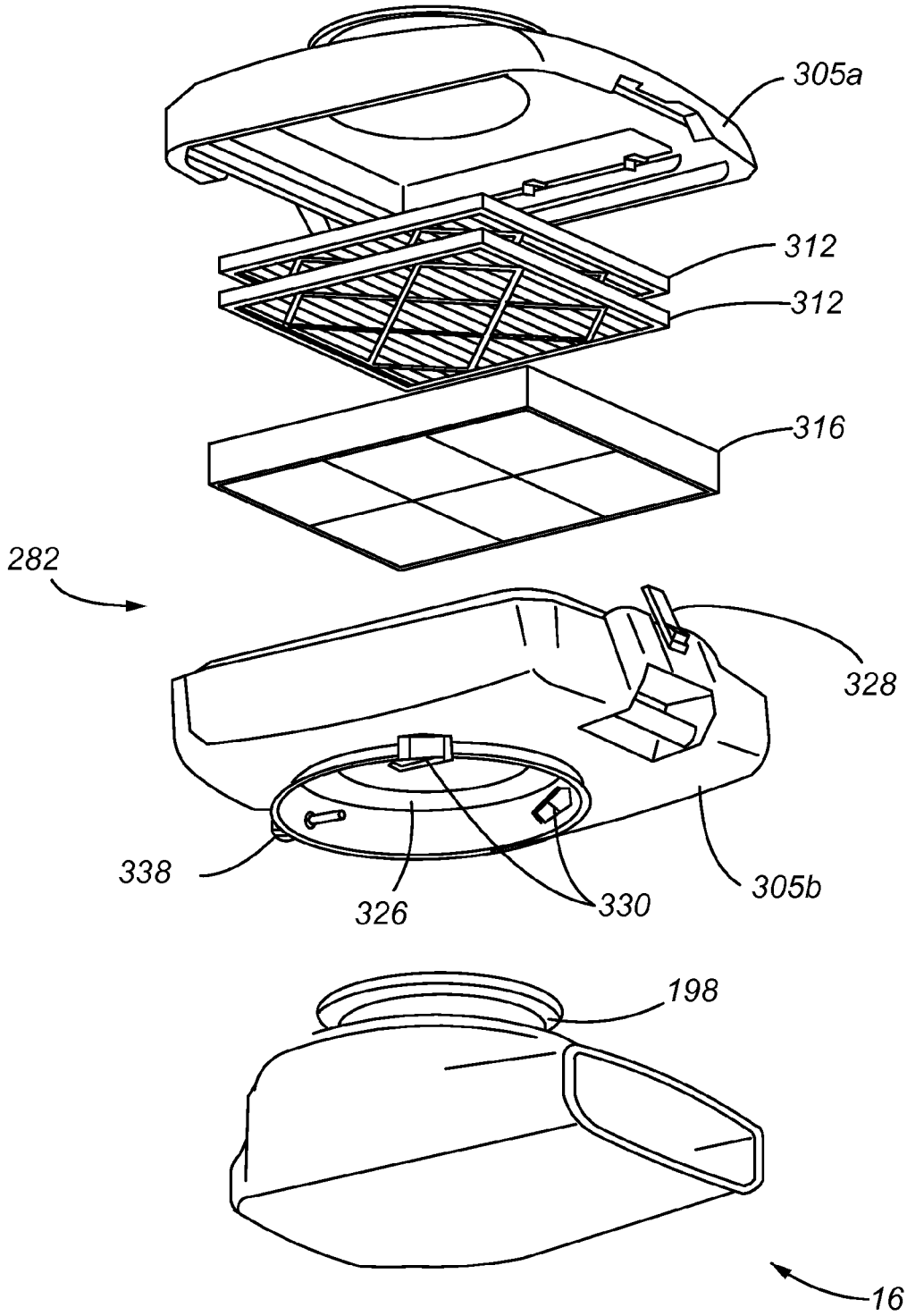
FIG. 35 is an exploded view of the filter assembly that can be connected to the air mover of the present invention.
Figure 36:
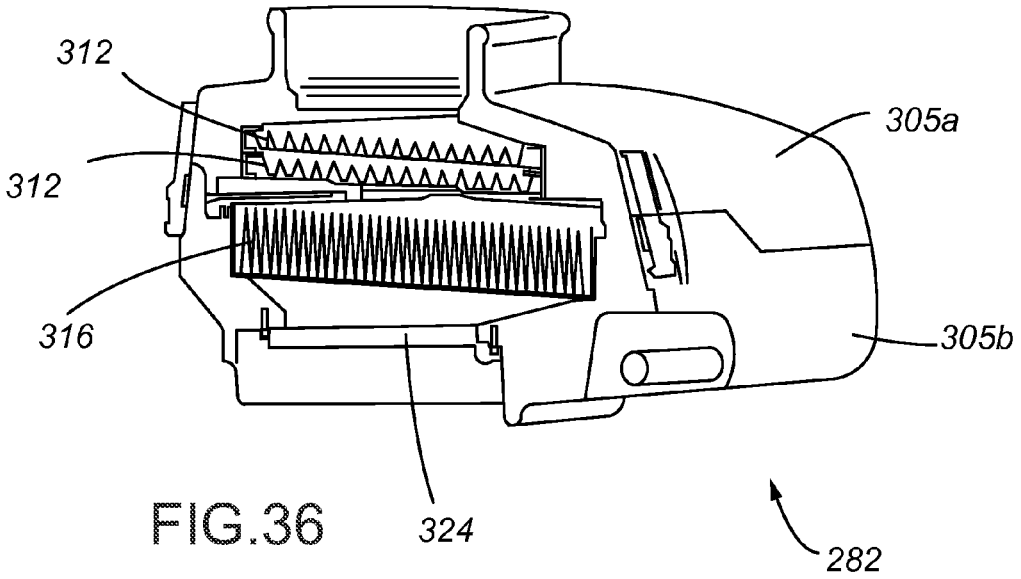
FIG. 36 is a cutaway view of the filter assembly that can be connected to the air mover of the present invention.
Figure 37:
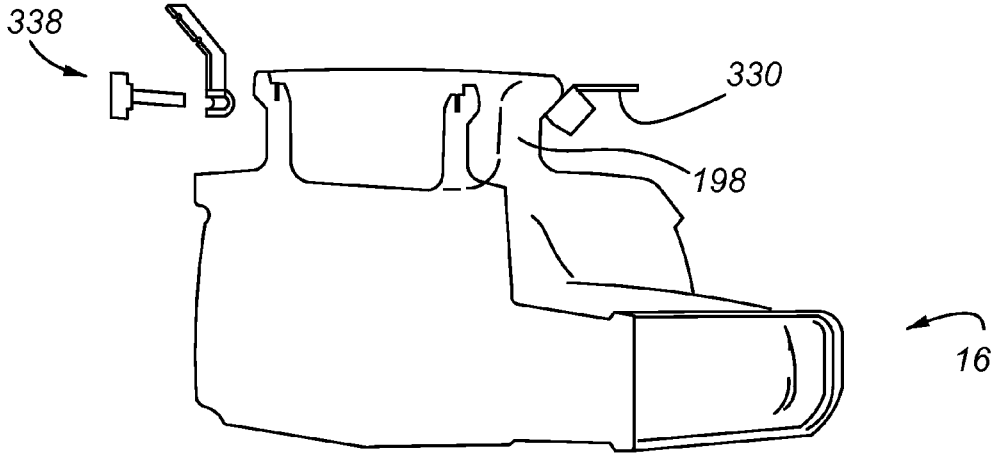
FIG. 37 is a second cutaway view of the filter assembly of the present invention.
Figure 38:
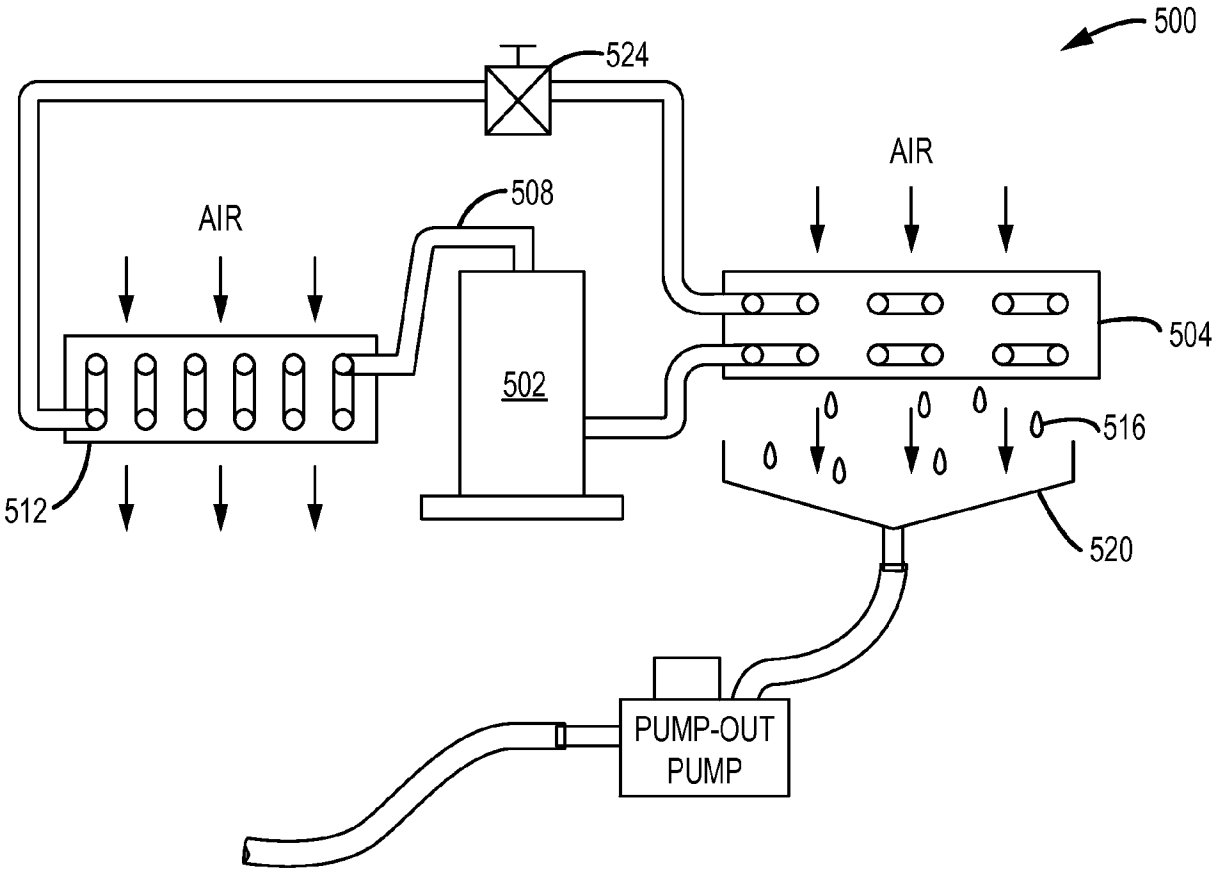
FIG.38 (PRIOR ART)
FIG. 38 is a schematic view showing a dehumidifier of the prior art.
Figure 39:
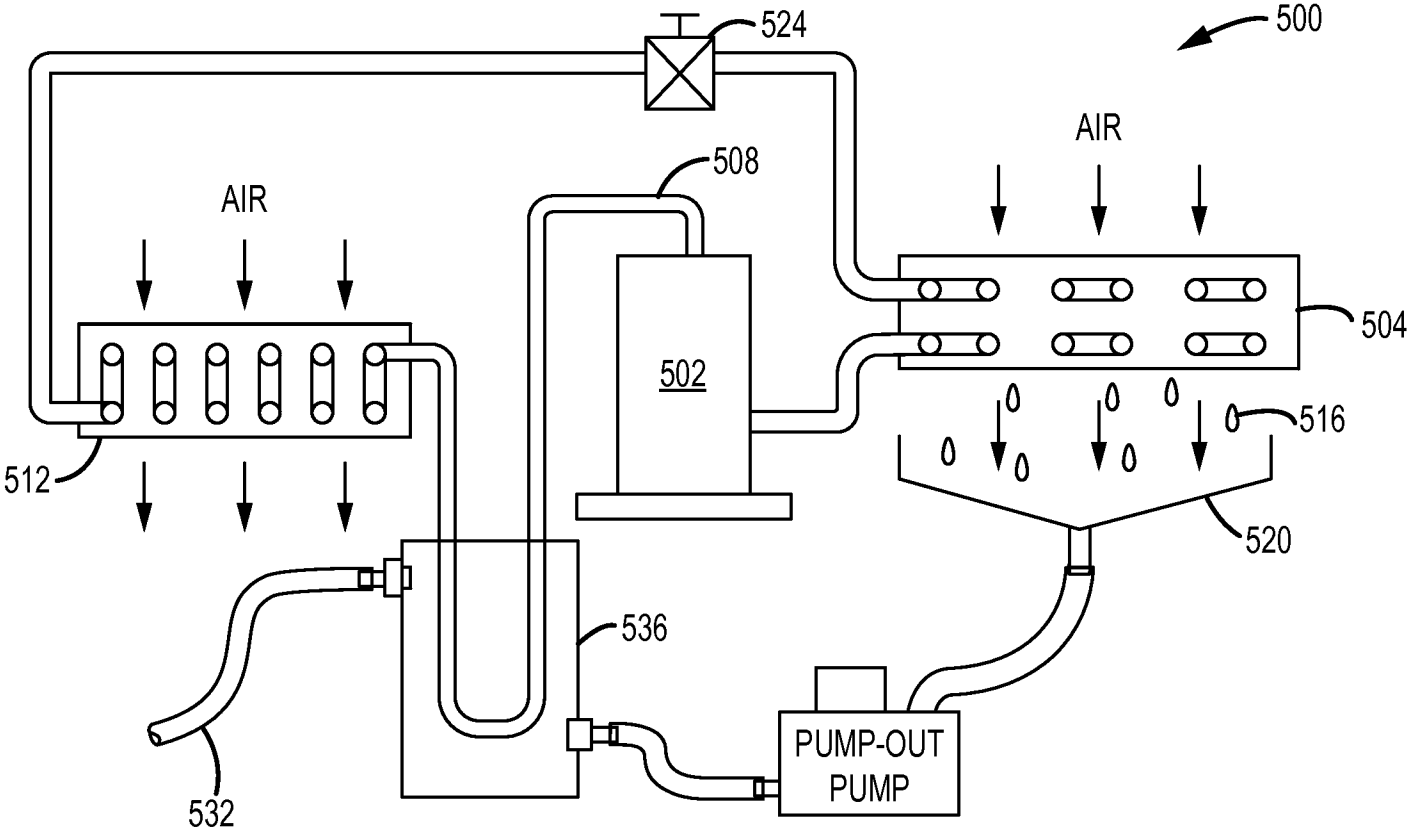
FIG. 39 is a schematic view showing a dehumidifier of one embodiment of the present invention.
Figure 40:
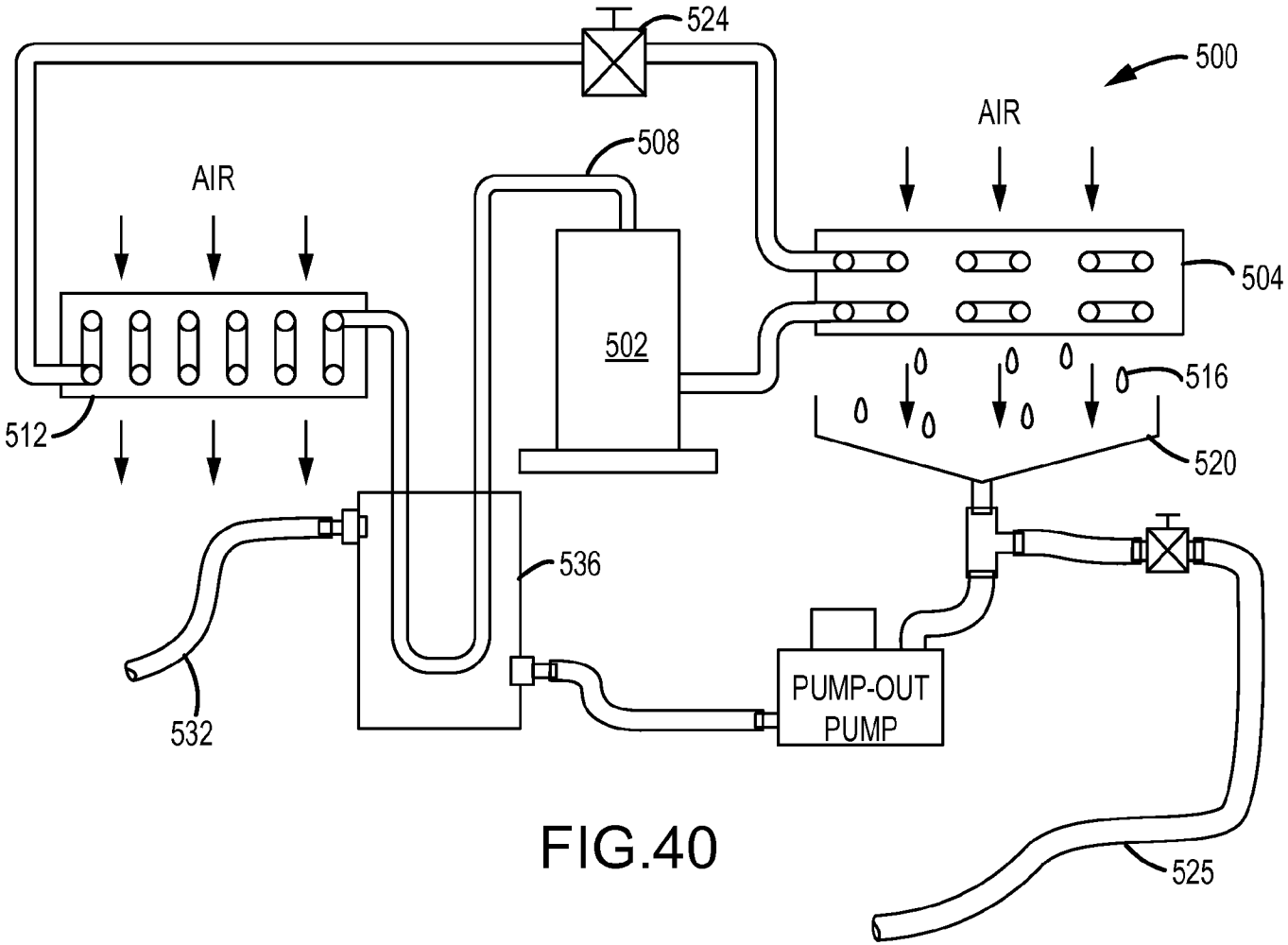
FIG. 40 is a schematic view showing a dehumidifier of another embodiment of the present invention.
Figure 41:
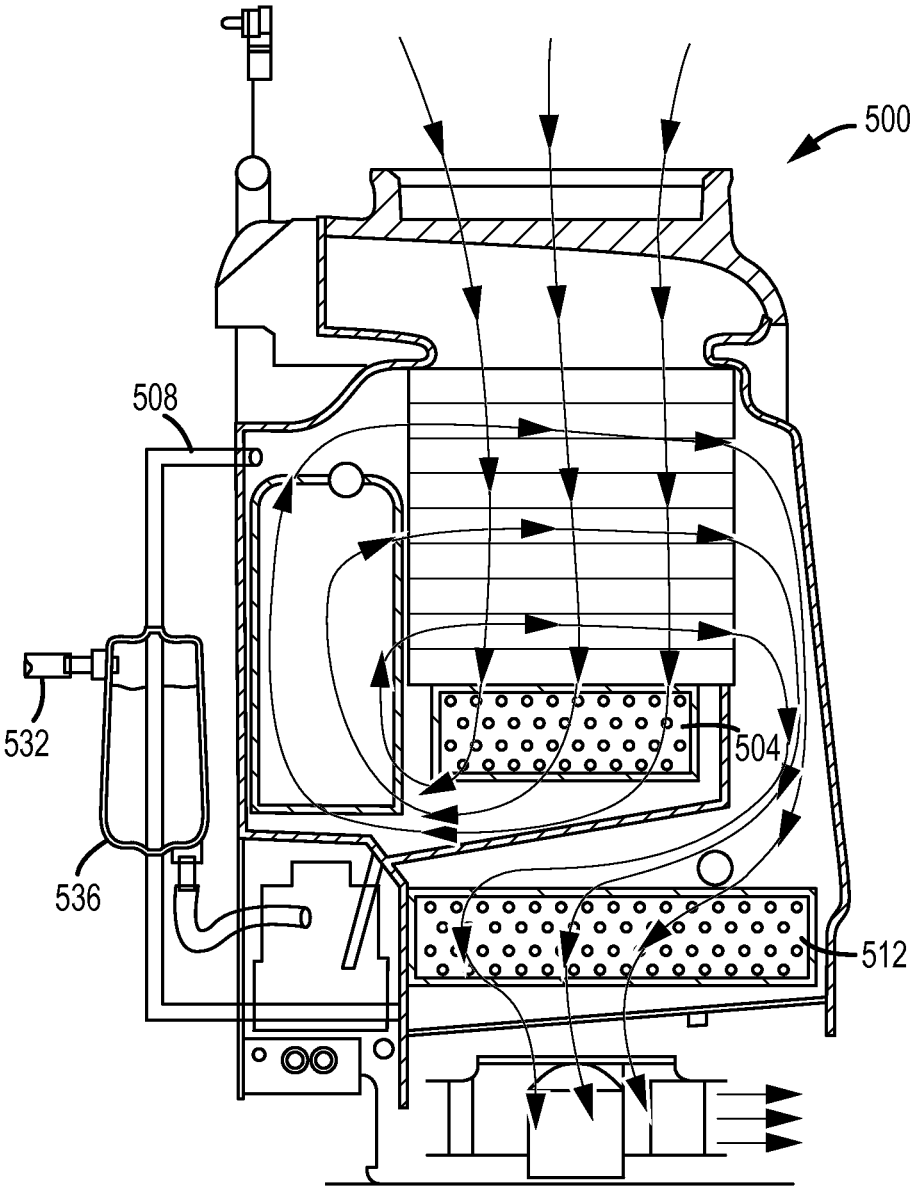
FIG. 41 depicts the physical embodiment of the dehumidifier shown in FIG. 55.

FIG. 33 depicts one embodiment wherein a filtration device 282 may be secured to a portion of an air mover 16. In one embodiment, one or more passive clamps 330 may be provided to attach a filtration device 282 to an air mover 16. Passive clamp 330 may be comprised of any number of known devices, including, but not limited to hooks, ramped members, magnets, and other similar fasteners. Passive clamps 330 may be fixedly attached to a portion of the filter housing 305*a* and *b* and capable of interfacing with a lip or flange portion 198 of an air mover 16. In one embodiment, passive clamps 330 do not require user adjustment. However, attachment mechanism 334 may be provided to tighten, apply, and/or remove passive clamps 330. Attachment mechanism 334 may be comprised of, for example, threaded holes within a portion of a housing 305*b* capable of accommodating screws and similar attachment means.

In one embodiment, passive clamps 330 act in conjunction with a screw clamp 338 as shown in FIGS. 34-37. Screw clamp 338 may communicate with a ramped or tapered portion of a flange 198 of an air mover 16. As the screw clamp 338 is rotated and thus driven inwards toward a flange 198, the torque applied to the screw, resulting in inward movement, and creating resistance provided by flange portion 46 that will force the housing portion 305*b* downward and in closer communication with an air mover 16. Accordingly, tightening the screw clamp may apply greater compression on an air mover sealing element 326 and provide a seal between the filtration device 282 and air mover 16. Various devices may be employed to assist the application of compression forces to sealing element 326. For example, a bracket 342 may be employed to reduce stress concentration imparted by the screw clamp 338. In one embodiment, the bracket 342 extends 360 degrees around a bottom portion of the filter housing 305*b* and thus facilitates the application of uniform pressure.

Various mating devices may also be employed at the interface of a screw clamp 338 and a flange portion 198 of air mover 16 to assist in the sealing of the unit and to mitigate damage caused to the flange 198. For example, various known mating plates may be applied to the intersection of the screw clamp 338 and the flange portion 198.

In one embodiment of the air filter, two passive clamps 330 and one screw clamp 338 are provided on the housing portion 304*b*. These three devices may be situated circumferentially and spaced approximately 120 degrees apart. However, the present invention is not limited to any specific number or arrangement of passive 330 or screw 338 clamps. It will be recognized that various embodiments, including, for example, embodiments which utilize only passive clamps 330 and those which utilize only screw clamps 338 are within the scope of the present invention.

Filter housing devices of various embodiments, as described herein, may comprise additional features to aid in the filtration and purification of air, gases, or fluids. For example, ozone injecting devices may be included within the filter housing. Methods and devices for injecting ozone are described in, for example, U.S. Pat. No. 5,839,155 to Berglund et al., which is hereby incorporated by reference in its entirety herein. Filter housing devices may also include devices such as ultraviolet light radiation means and chemical injection means to sanitize or disinfect air, either before or after passing through filter elements.

In various embodiments of the present invention, a filter device (or other devices) may further include systems to dispel or atomize substances in order to disinfect, freshen, or otherwise modify air. For example, an atomizer may be incorporated within an air flow path of a filter device, either within or proximal to the filter stages, and offer a user the ability to selectively disperse various chemical, cleaners, and/or fragrances to an area via the air flow produced by the filter device 282. Various commercial devices are currently known which provide the ability to selectively release such substances and/or to release substances on specific or random time intervals. Materials to be used with such spraying mechanisms include, but are not limited to desiccants, disinfectants, air fresheners, and similar substances known to those working in the art.

The Dehumidifiers

Dehumidifiers are generally comprised of a compressor 502, evaporator 504 and condenser 512 that are interconnected by a series of tubes that carry refrigerant. The compressor 502 delivers hot compressed refrigerant gas to the condenser 512. The condenser 512 condenses the hot compressed refrigerant gas into hot refrigerant liquid. An expansion device 524 receives the refrigerant liquid from the condenser and expands same, thereby rapidity reducing its temperature and pressure. The evaporator 504 receives the cool liquid refrigerant from the expansion device, producing a cold gas refrigerant, which is returned to the compressor 502 to complete the refrigeration cycle. Air flow is directed across the evaporator 504 to cool the air below the dew point thereof such that water vapor, i.e. humidity, in that air is condensed to a liquid that separates from the air, thus, dehumidifying the air. The dehumidified air is then directed across the condenser 512 to aid in the condensing of the refrigerant therein. For a concise explanation of dehumidifiers and portable dehumidifiers see above-identified U.S. Pat. No. 7,281,398. Embodiments of the present invention employ common dehumidifiers. Other embodiments employ a dehumidifiers that include a Thermal Expansion Valve as disclosed in U.S. Patent Application Publication No. 20100326103. Still other embodiments employ the dehumidifier described below.

More specifically, FIGS. 38-41 show a dehumidifier 500 of another embodiment of the present invention that uses cold condensate from an evaporator 504 to cool a hot discharge 508 expelled from the compressor 502. The efficiency of the dehumidifier 500 may be augmented with cold water from an outside source. The system also produces hot or warm water that can be used elsewhere in the system. More specifically, the hot discharge fluid 508 taken from the compressor 502 is thermally exposed to cool water 516 from a catch pan 520 that receives water droplets from the evaporator 504. The hot discharge 508 is cooled prior to entering the condenser 512, which helps the condenser 512 further cool the refrigeration fluid of the dehumidifier. An expansion valve 524 or capillary tube is employed between the condenser 512 and evaporator 504 to control the flow of refrigerant through the dehumidifier 500 similar to that described above. As shown in FIG. 55, cool water 525 may be added to the fluids 516 captured by the catch pan 520. A hose 532 may also be associated with a tank 536 that holds the fluid taken from the evaporator 504 that drains the tank 536 or sends heated water to a second location.

While various embodiments the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate for the intended end use of the band. The dimensions of the component pieces may also vary, yet still be within the scope of the invention. This method of disclosure is not to be interpreted as reflecting an intention that the claimed invention requires more features than are expressly recited in each claim. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation. Rather, as the following claims reflect, inventive aspects lie in less than all features of any single foregoing disclosed embodiment. Thus, the following claims are hereby incorporated into this Detailed Description, with each claim standing on its own as a separate embodiment of the invention.

What is claimed is:

1. A method of remediating a water-damaged building, comprising:

providing a self-contained power and control device;

providing at least one drying component;

providing at least one sensor;

placing the at least one drying component in a water-damaged area of the building;

connecting a power source to the power and control device;

selectively directing the current received by the power and control device to at least one of the at least one drying component;

providing drying criteria to the power and control device;

gathering moisture content data from the at least one sensor;

using the drying criteria and the moisture content data to control the function of the at least one drying component; and wherein the power and control device includes a processor that accepts data received from the at least one sensor and data from the at least one drying component and directs the at least one drying component to cease functioning when a predetermined dew point value of a given remediation area is approached.

2. The method of claim 1, further comprising outputting information to a site other than the water-damaged building.

3. The method of claim 2, wherein the information is outputted from the power and control device includes information related to at least one of current draw by the power and control device, current draw by the at least one drying component, and data gathered by the at least one sensor.

4. The method of claim 1, wherein the power and control device communicates wirelessly with a server that is selectively accessed by a user.

5. The method of claim 1, further comprising ceasing the function of the at least one drying component when the moisture content of the area being remediated is dried to a predetermined level.

6. The method of claim 1 wherein the power and control device, comprises:

an outer case for housing electronic circuitry, the circuitry including: power collection and distribution circuitry, circuitry for collecting data from the at least one sensor, circuitry for transmitting data to the at least one drying component, circuitry to transmit data to and to receive data from a remote server, and circuitry that aids in proper installation, monitoring, and control of the at least one drying component;

a plurality of electrical power inlets;

a plurality of electrical power outlets; and a user interface that allows the user to modify the amount of power supplied to at least one of the plurality of power outlets.

7. The method of claim 1, wherein the power and control device controls and monitors at least three separate drying zones in the water-damaged building.

8. The method of claim 1, wherein the at least one drying component comprises at least one of a fan and a dehumidifying device.

9. The method of claim 1, wherein the at least one sensor is a battery-powered device that measures temperature and relative humidity.

10. The method of claim 1, wherein the at least one drying component is a dehumidifier that employs a thermal expansion valve to control the flow of refrigerant.

11. The method of claim 1, wherein the at least one drying component is an air mover that employs an air filtering or air treating device.

12. The method of claim 1, wherein the at least one sensor includes a penetrating moisture sensor that includes penetrating members that contacts moisture-damaged wood.

13. The method of claim 12, wherein the penetrating moisture sensor measures the electrical resistance of the moisture-damaged wood and correlates the measured electrical resistance to a moisture content value that is independent of the type of wood to which the penetrating moisture sensor is associated.

14. A method of remediating a water-damaged building, comprising:

providing a self-contained power and control device;

providing at least one drying component;

providing at least one sensor;

placing the at least one drying component in a water-damaged area of the building;

connecting a power source to the power and control device;

selectively directing the current received by the power and control device to at least one of the at least one drying component;

providing drying criteria to the power and control device;

gathering moisture content data from the at least one sensor;

using the drying criteria and the moisture content data to control the function of the at least one drying component; and wherein the power and control device controls and monitors at least three separate drying zones in the water-damaged building.

15. The method of claim 14, further comprising outputting information to a site other than the water-damaged building.

16. The method of claim 15, wherein the information is outputted from the power and control device includes information related to at least one of current draw by the power and control device, current draw by the at least one drying component, and data gathered by the at least one sensor.

17. The method of claim 14, wherein the power and control device communicates wirelessly with a server that is selectively accessed by a user.

18. The method of claim 14, further comprising ceasing the function of the at least one drying component when the moisture content of the area being remediated is dried to a predetermined level.

19. The method of claim 14 wherein the power and control device, comprises:

an outer case for housing electronic circuitry, the circuitry including: power collection and distribution circuitry, circuitry for collecting data from the at least one sensor, circuitry for transmitting data to the at least one drying component, circuitry to transmit data to and to receive data from a remote server, and circuitry that aids in proper installation, monitoring, and control of the at least one drying component;

a plurality of electrical power inlets;

a plurality of electrical power outlets; and a user interface that allows the user to modify the amount of power supplied to at least one of the plurality of power outlets.

20. The method of claim 14, wherein the at least one drying component comprises at least one of a fan and a dehumidifying device.

21. The method of claim 14, wherein the at least one sensor is a battery- powered device that measures temperature and relative humidity.

22. The method of claim 14, wherein the at least one drying component is a dehumidifier that employs a thermal expansion valve to control the flow of refrigerant.

23. The method of claim 14, wherein the at least one drying component is an air mover that employs an air filtering or air treating device.

24. The method of claim 14, wherein the at least one sensor includes a penetrating moisture sensor that includes penetrating members that contacts moisture- damaged wood.

25. The method of claim 24, wherein the penetrating moisture sensor measures the electrical resistance of the moisture-damaged wood and correlates the measured electrical resistance to a moisture content value that is independent of the type of wood to which the penetrating moisture sensor is associated.

* * * * *